US010022854B2

(12) United States Patent
Ikuta

(10) Patent No.: US 10,022,854 B2
(45) Date of Patent: Jul. 17, 2018

(54) POWER TOOL

(71) Applicant: MAKITA CORPORATION, Anjo-shi, Aichi (JP)

(72) Inventor: Hiroki Ikuta, Anjo (JP)

(73) Assignee: MAKITA CORPORATON, Anjo (JP)

( * ) Notice: Subject to any disclaimer, the term of this patent is extended or adjusted under 35 U.S.C. 154(b) by 517 days.

(21) Appl. No.: 14/835,228

(22) Filed: Aug. 25, 2015

(65) Prior Publication Data

US 2016/0059401 A1 Mar. 3, 2016

(30) Foreign Application Priority Data

Aug. 27, 2014 (JP) ..... 2014-173252

(51) Int. Cl.
*B25F 5/00* (2006.01)

(52) U.S. Cl.
CPC ..... *B25F 5/001* (2013.01)

(58) Field of Classification Search
CPC .... B25F 5/001; B25B 21/007; B25B 23/0035
USPC ..... 173/213, 164
See application file for complete search history.

(56) References Cited

U.S. PATENT DOCUMENTS

2003/0233917 A1 12/2003 Sasaki
2012/0160530 A1 6/2012 Ikuta et al.

FOREIGN PATENT DOCUMENTS

DE 3329295 A1 2/1985
DE 103 08 272 A1 10/2003
JP H0911148 A 1/1997
JP 2012-135842 A 7/2012

OTHER PUBLICATIONS

Mar. 11, 2016 Office Action issued in German Patent Application No. 10 2015 011 116.7.
Dec. 11, 2017 Office Action issued in Japanese Patent Application No. 2014-173252.

*Primary Examiner* — Gloria R Weeks
(74) *Attorney, Agent, or Firm* — Oliff PLC

(57) ABSTRACT

It is an object to provide a novel technique for releasing an intervening member of a driving member. A representative screwdriver is provided with a motor and a driving mechanism. The driving mechanism has a spindle, a lock sleeve, rollers, a driving gear, a retainer and a spring receiver. When driven with the rollers held between the lock sleeve and the driving gear, the spindle is rotated in a normal direction. The lock sleeve has an inclined part and the retainer has an inclined part. The lock sleeve and the retainer move with respect to each other in the axial direction and the circumferential direction by sliding contact between the inclined parts. This relative movement in the circumferential direction is utilized to release the holding of the rollers.

14 Claims, 19 Drawing Sheets

POWER TOOL

TECHNICAL FIELD

The present invention relates to a power tool that rotationally drives a tool accessory.

BACKGROUND ART

Japanese laid-open patent publication No. H09-011148 discloses a screw tightening tool that performs a screw tightening operation by driving a tool bit coupled to an output shaft member. In this screw tightening tool, when performing a screw tightening operation, a motor rotationally drives the output shaft member with a screw attached to a tip of the tool bit and pressed against a workpiece.

SUMMARY OF THE INVENTION

Problem to be Solved by the Invention

In the above-described screw tightening tool, when an intervening member is held between a driving shaft member and the output shaft member, rotation of the motor is transmitted to the output shaft member via the intervening member. Thus, the tool bit is driven and perform a screw tightening operation. Further, when the holding of the intervening member is released, transmission of rotation of the motor is interrupted and the screw tightening operation is completed. In this screw tightening tool, the holding of the intervening member is released by utilizing a biasing force of a spring. Accordingly, it is an object of the present invention to provide a novel technique for releasing an intervening member in a driving mechanism of a power tool of the type in which rotation of the motor is transmitted to a tool accessory driving shaft by holding the intervening member.

In order to solve the above-described problem, according to a preferred aspect of the present invention, a power tool is provided which performs a prescribed operation by rotationally driving a tool accessory detachably coupled to a front end region of the power tool. The power tool includes a motor and a driving mechanism that is driven by the motor and rotationally drives the tool accessory. The driving mechanism includes a tool accessory driving shaft to which the tool accessory is coupled, a driving member that is coaxially disposed with the tool accessory driving shaft and rotationally driven by the motor, and an intervening member that is disposed between the tool accessory driving shaft and the driving member and transmits rotation of the driving member to the tool accessory driving shaft when held between the tool accessory driving shaft and the driving member, while interrupting the transmission of rotation of the driving member to the tool accessory driving shaft when released from the holding. The intervening member suitably has a cylindrical, conical, spherical or prismatic shape or a pyramid shape. The power tool further has a releasing mechanism that is driven by the motor and releases the holding. The intervening member may be held either between the tool accessory driving shaft and the driving member, or between a holding member disposed between the tool accessory driving shaft and the driving member and the tool accessory driving shaft or the driving member. Typically, by the wedge effect of the intervening member held therebetween, the driving member and the tool accessory driving shaft are integrated. Preferably, at least one of components for forming the driving mechanism forms the releasing mechanism.

According to this invention, with the structure having the releasing mechanism which is driven by the motor and releases the holding of the intervening member, compared with a structure, for example, in which a biasing force of a spring is utilized to release the holding of the intervening member, the holding of the intervening member can be more reliably released.

According to a further aspect of the power tool of the present invention, the tool accessory driving shaft is configured to be movable between a first position close to the front end region and a second position away from the front end region in an axial direction of the tool accessory driving shaft. When the tool accessory driving shaft is located in the second position, the intervening member is held between the tool accessory driving shaft and the driving member in a prescribed holding position and transmits rotation of the driving member to the tool accessory driving shaft. When the tool accessory driving shaft is located in the first position, the intervening member is disposed in a holding disabled position which is different from the holding position and in which the intervening member is not held between the tool accessory driving shaft and the driving member, so that the transmission of rotation of the driving member to the tool accessory driving shaft is interrupted.

According to this aspect, the intervening member is moved between the holding position and the holding disabled position according to the position of the tool accessory driving shaft in the axial direction. Therefore, the power tool is provided to perform an operation, for example, by pressing the tool accessory against a workpiece so as to move the tool accessory driving shaft in the axial direction.

According to a further aspect of the power tool of the present invention, the releasing mechanism moves the tool accessory driving shaft from the second position to the first position in the axial direction of the tool accessory driving shaft, and at the same time, moves the intervening member from the holding position to the holding disabled position in a circumferential direction around an axis of the tool accessory driving shaft.

Typically, the releasing mechanism includes a first element and a second element that can get into contact with the first element. One of the first element and the second element has an inclined surface inclined at a prescribed angle with respect to the axial direction of the tool accessory driving shaft, and the other element has a contact part that can get into contact with the inclined surface.

The intervening member is moved from the holding position to the holding disabled position by the releasing mechanism. Specifically, in a state in which the tool accessory driving shaft is located in the second position and the intervening member is held between the tool accessory driving shaft and the driving member in the holding position, when the first element and the second element move with respect to each other in the circumferential direction of the tool accessory driving shaft by rotation of the motor, the contact part slides in contact with the inclined surface and the first and second elements move with respect to each other in the axial direction of the tool accessory driving shaft. Thus, the releasing mechanism moves the tool accessory driving shaft from the second position to the first position, and at the same time, moves the intervening member from the holding position to the holding disabled position.

Further, in a state in which the tool accessory driving shaft is located in the first position and the intervening member is not held between the tool accessory driving shaft and the driving member in the holding disabled position, when the first element and the second element move with respect to each other in the axial direction of the tool accessory driving shaft by movement of the tool accessory driving shaft from the first position to the second position, the contact part slides in contact with the inclined surface and the first and second elements move with respect to each other in the circumferential direction of the tool accessory driving shaft. Thus, the releasing mechanism moves the intervening member from the holding disabled position to the holding position. As a result, the intervening member is held between the tool accessory driving shaft and the driving member in the holding position. Therefore, the releasing mechanism also serves to cause the intervening member to be held between the tool accessory driving shaft and the driving member.

According to a further aspect of the power tool of the present invention, the second element is configured as a retainer that retains the intervening member in the holding position and the holding disabled position and rotates together with the tool accessory driving shaft with the intervening member held in the holding position. The retainer is configured as part of the driving mechanism. Therefore, a component of the driving mechanism is also utilized for the releasing mechanism, so that the number of parts of the power tool is reduced.

According to a further aspect of the power tool of the present invention, the tool accessory driving shaft includes a tool accessory holding shaft that holds the tool accessory, and a first holding member that can hold the intervening member between the first holding member and the driving member and rotates together with the tool accessory holding shaft while holding the intervening member therebetween. The first element is formed by the first holding member. The first holding member is configured as part of the driving mechanism. Therefore, a component of the driving mechanism is also utilized for the releasing mechanism, so that the number of parts of the power tool is reduced.

According to a further aspect of the power tool of the present invention, the tool accessory driving shaft further includes a second holding member. When the intervening member is held between the first holding member and the driving member, normal rotation of the motor is transmitted to the tool accessory holding shaft. When the intervening member is held between the second holding member and the driving member, reverse rotation of the motor is transmitted to the tool accessory holding shaft. Therefore, whether the tool accessory is rotationally driven in the normal direction or in the reverse direction, the operation is performed. This aspect is useful for the power tool such as a screw tightening tool.

According to a further aspect of the power tool of the present invention, the retainer is configured as a ring-like member that is coaxially disposed with the tool accessory driving shaft. The second holding member is disposed inward of the outer periphery of the retainer in a radial direction of the retainer. Thus, the second holding member is disposed inside the retainer, so that the power tool can be reduced in size in the radial direction of the retainer.

According to a further aspect of the power tool of the present invention, the retainer is configured as a ring-like member that is coaxially disposed with the tool accessory driving shaft, and has a retaining part that retains the intervening member at a prescribed distance away from a rotation axis of the tool accessory driving shaft in a radial direction of the retainer. The first holding member has the inclined surface which is formed in a region at the prescribed distance away from the rotation axis of the tool accessory driving shaft in the radial direction of the retainer and configured to correspond to the retaining part, and a holding part which is formed on the rotation axis side with respect to the inclined surface and can hold the intervening member between the holding part and the driving member. With this structure, the first holding member does not protrude from the outer periphery of the retainer in the radial direction of the retainer, so that the power tool can be reduced in size in the radial direction of the retainer.

According to a further aspect of the power tool of the present invention, the intervening member is formed by a plurality of rollers extending in the axial direction of the tool accessory driving shaft. The retaining part of the retainer is provided between the rollers and has the contact part configured as a second inclined surface which is inclined in the axial direction of the tool accessory driving shaft at the same angle as the first inclined surface. With this structure, the area of contact between the first and second inclined surfaces increases, so that the retainer and the first holding member can be smoothly moved with respect to each other in the axial direction and the circumferential direction.

According to a further aspect of the power tool of the present invention, the power tool further has a biasing member that always biases the tool accessory driving shaft toward the front end region. When releasing the holding of the intervening member, the releasing mechanism can utilize not only the relative movement of the first and second elements in the axial direction and the circumferential direction, but also the biasing force of the biasing member.

According to a further aspect of the power tool of the present invention, the driving member is cylindrically shaped. The power tool further has a biased member that is biased in the radial direction of the driving member by the biasing member so as to get in contact with an inner circumferential surface of the driving member. Typically, the biased member is formed by a ball which can move in the radial direction and the circumferential direction of the driving member. When the motor is rotated reversely, the biased member moves the intervening member in the circumferential direction of the driving member by utilizing rotation of the driving member such that the intervening member is held between the driving member and the second holding member.

Effect of the Invention

According to the present invention, a novel technique for releasing an intervening member is provided.

DETAILED REPRESENTATIVE EMBODIMENT FOR PERFORMING THE INVENTION

First Embodiment

Figure 1:
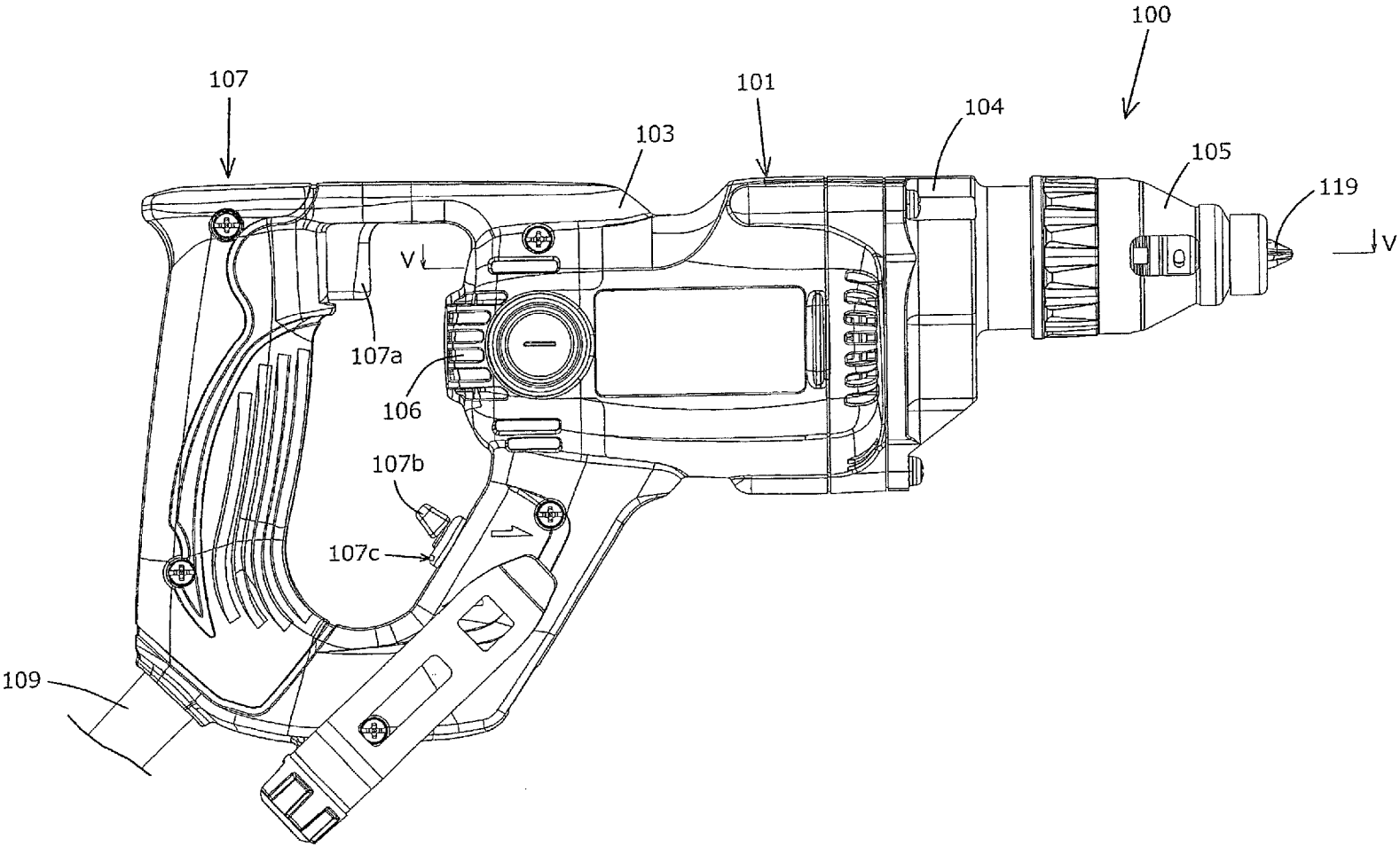
FIG. 1 is a side view schematically showing the overall structure of a screwdriver according to a first embodiment of the present invention.

A first embodiment of the present invention is now described with reference to FIGS. 1 to 25. As shown in FIG. 1, as a representative embodiment of a power tool according to the present invention, a screwdriver 100 which performs a prescribed operation on a workpiece such as a gypsum board is described. The screwdriver 100 mainly includes a body 101 and a handle 107. A tool bit 119 is detachably coupled to a front end region of the body 101. For the sake of convenience of explanation, the tool bit 119 side (the right as viewed in FIG. 1) is defined as the front of the screwdriver 100 and the handle 107 side (the left as viewed in FIG. 1) is defined as the rear of the screwdriver 100, in the axial direction of the tool bit 119 (the horizontal direction as viewed in FIG. 1). Further, the upper side in FIG. 1 is defined as the upper side of the screwdriver 100 and the lower side in FIG. 1 is defined as the lower side of the screwdriver 100, in the vertical direction in FIG. 1.

Figure 2:
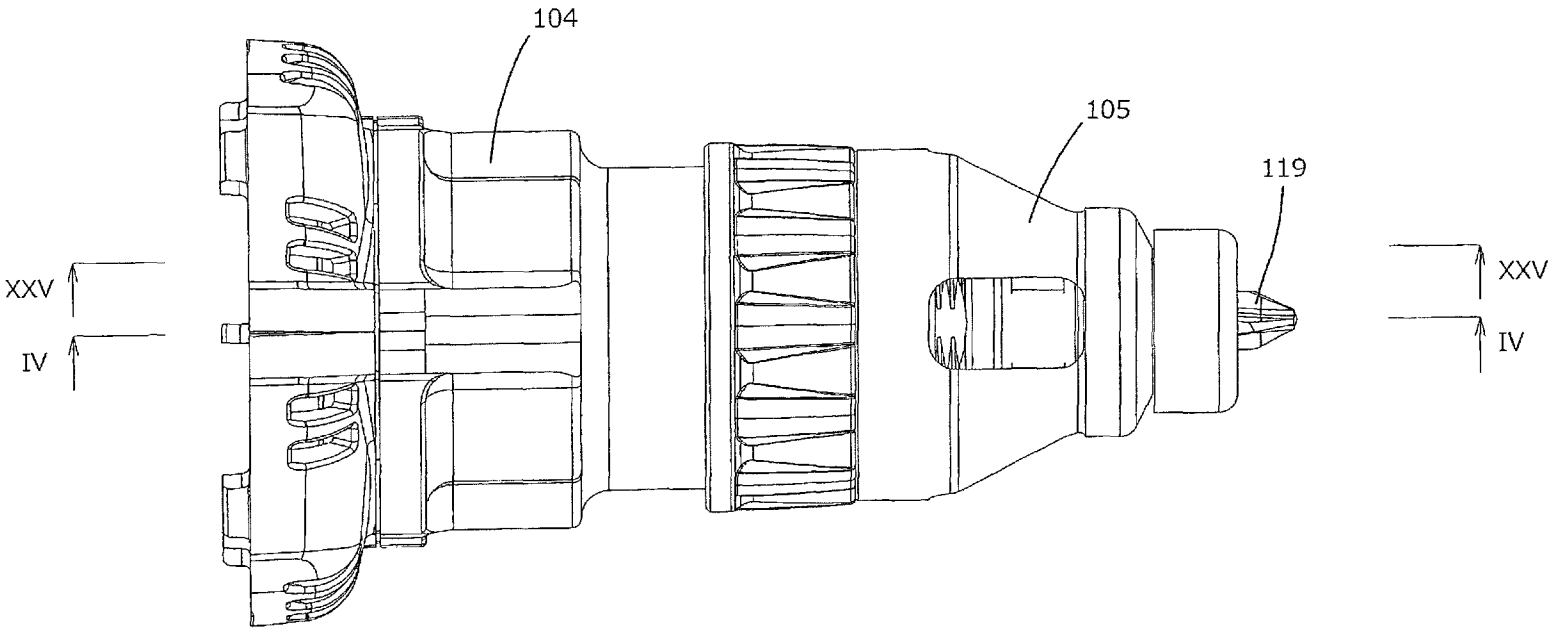
FIG. 2 is a bottom view of a part of the screwdriver.
Figure 3:
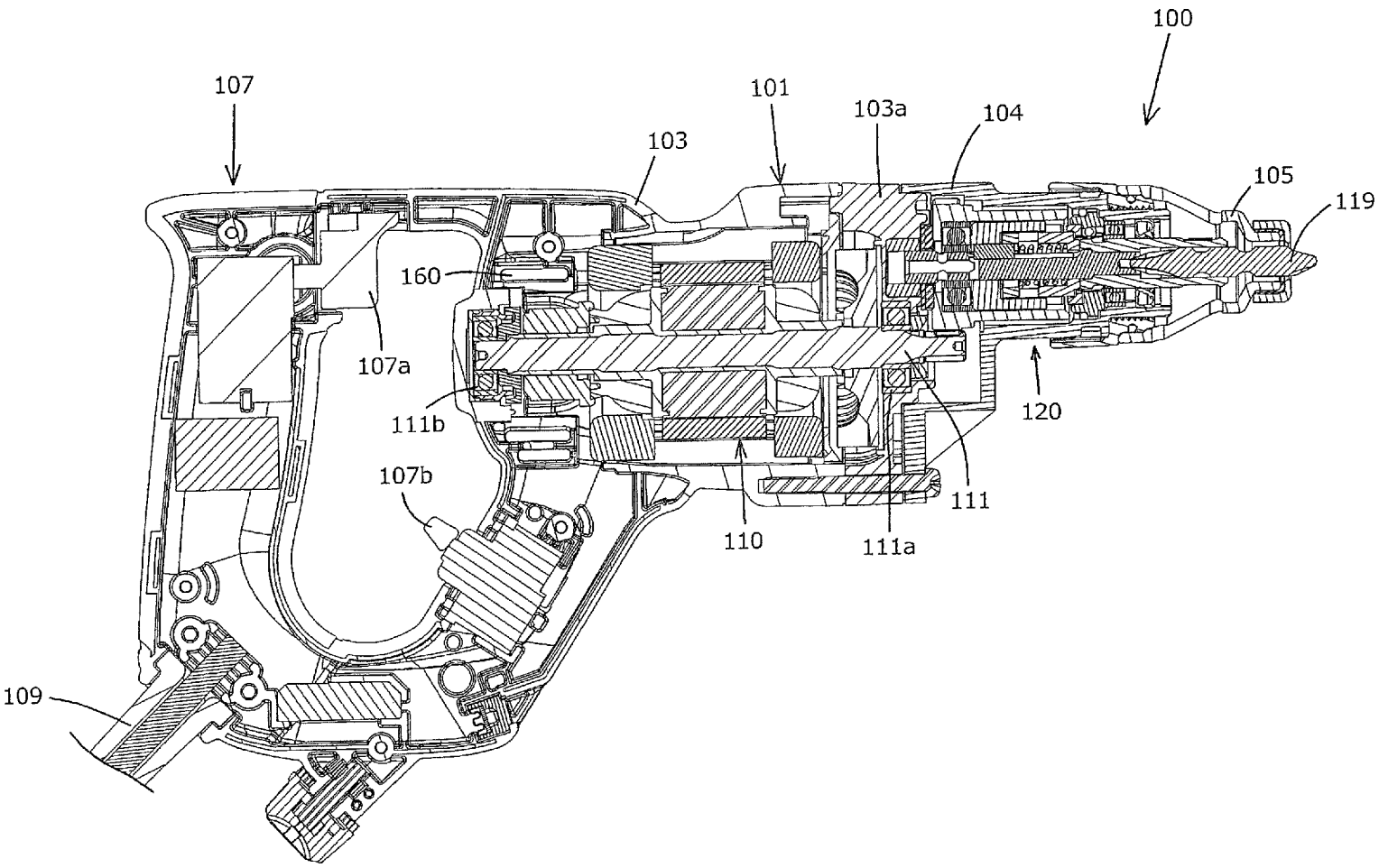
FIG. 3 is a sectional view of the screwdriver.

As shown in FIGS. 1 to 3, the body 101 mainly includes a main housing 103, a front housing 104 and a locator 105. The main housing 103 mainly houses a motor 110, and the front housing 104 is mounted to the front of the main housing 103 and houses a driving mechanism 120. The driving mechanism 120 is an example embodiment that corresponds to the "driving mechanism" according to the present invention.

As shown in FIG. 3, a partition wall 103*a* for demarcating the inside of the main housing 103 from the inside of the front housing 104 is formed on the front end of the main housing 103 and extends in the vertical direction. An output shaft 111 of the motor 110 is rotatably supported by a bearing 111*a* held by the partition wall 103*a* and a bearing 111*b* held by a rear portion of the main housing 103. The output shaft 111 is disposed in parallel to the axial direction of the tool bit 119 (a spindle 160). The locator 105 is mounted to cover the front housing 104 in a front end region of the front housing 104. The tool bit 119 is detachably coupled to the driving mechanism 120 such that a tip of the tool bit 119 protrudes forward from the locator 105 in the front end region of the body 101. The locator 105 can move in the axial direction of the tool bit 119 with respect to the front housing 104 and fixed in a predetermined position selected in the axial direction. Thus, the amount of protrusion of the tool bit 119 from the locator 105, or the screwing depth is appropriately set.

The handle 107 is connected to the rear of the body 101 (the main housing 103). The handle 107 has a trigger 107*a* and a changeover switch 107*b*. When the trigger 107*a* is operated, electric current is supplied from outside via a power cable 109 and the motor 110 is driven. Further, the direction of rotation of the output shaft 111 of the motor 110 is switched by operating the changeover switch 107*b*. Specifically, the output shaft 111 is driven in a selected direction of either one of normal rotation and reverse rotation. The motor 110 is an example embodiment that corresponds to the "motor" according to the present invention.

(Driving Mechanism)

As shown in FIGS. 3 to 12, the driving mechanism 120 mainly includes a driving gear 125, a retainer 130, a roller 140, a lock sleeve 145, a spring receiver 150, a coil spring 155 and a spindle 160.

(Driving Gear)

Figure 4:
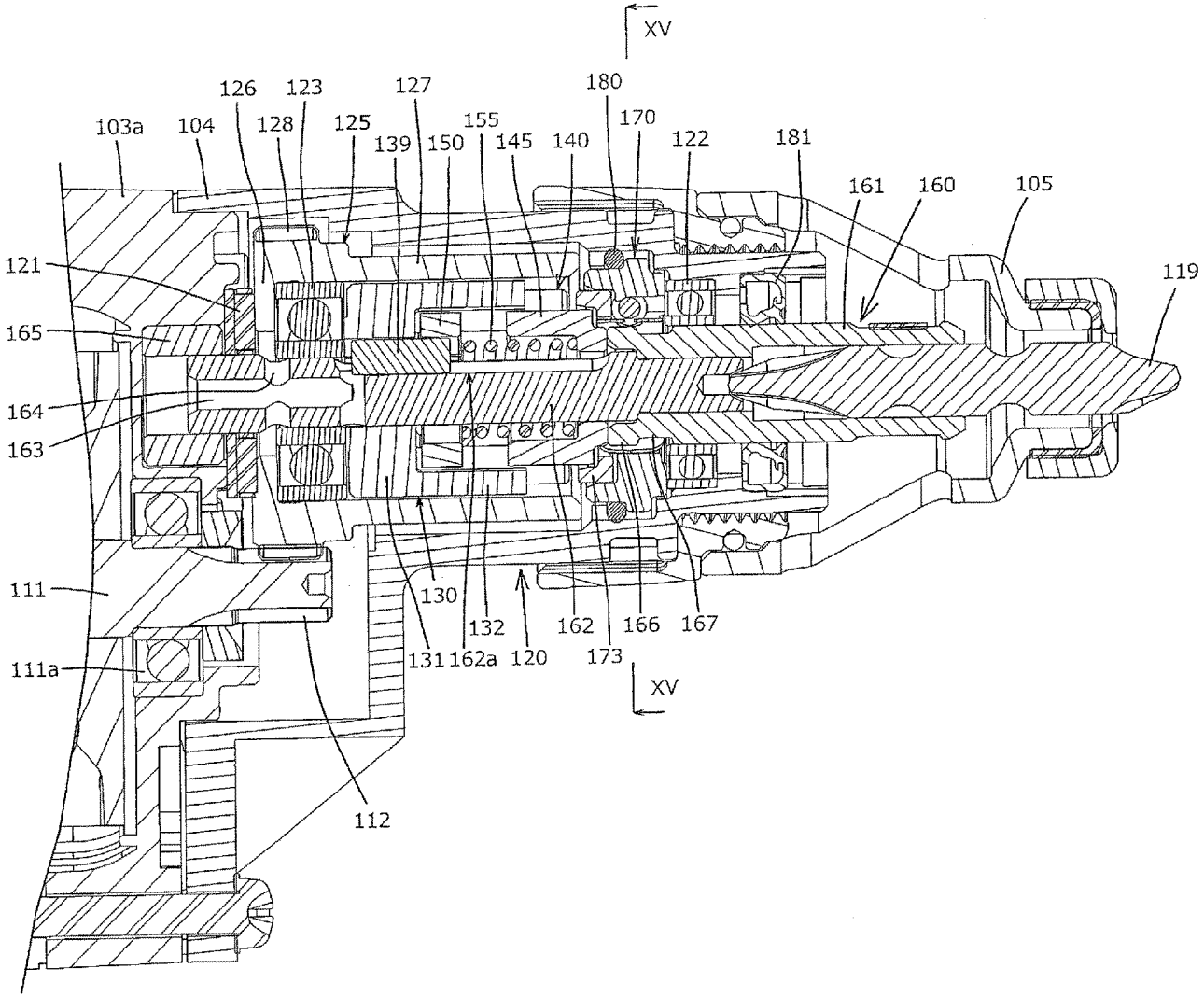
FIG. 4 is a sectional view taken along line IV-IV in FIG. 2.
Figure 5:
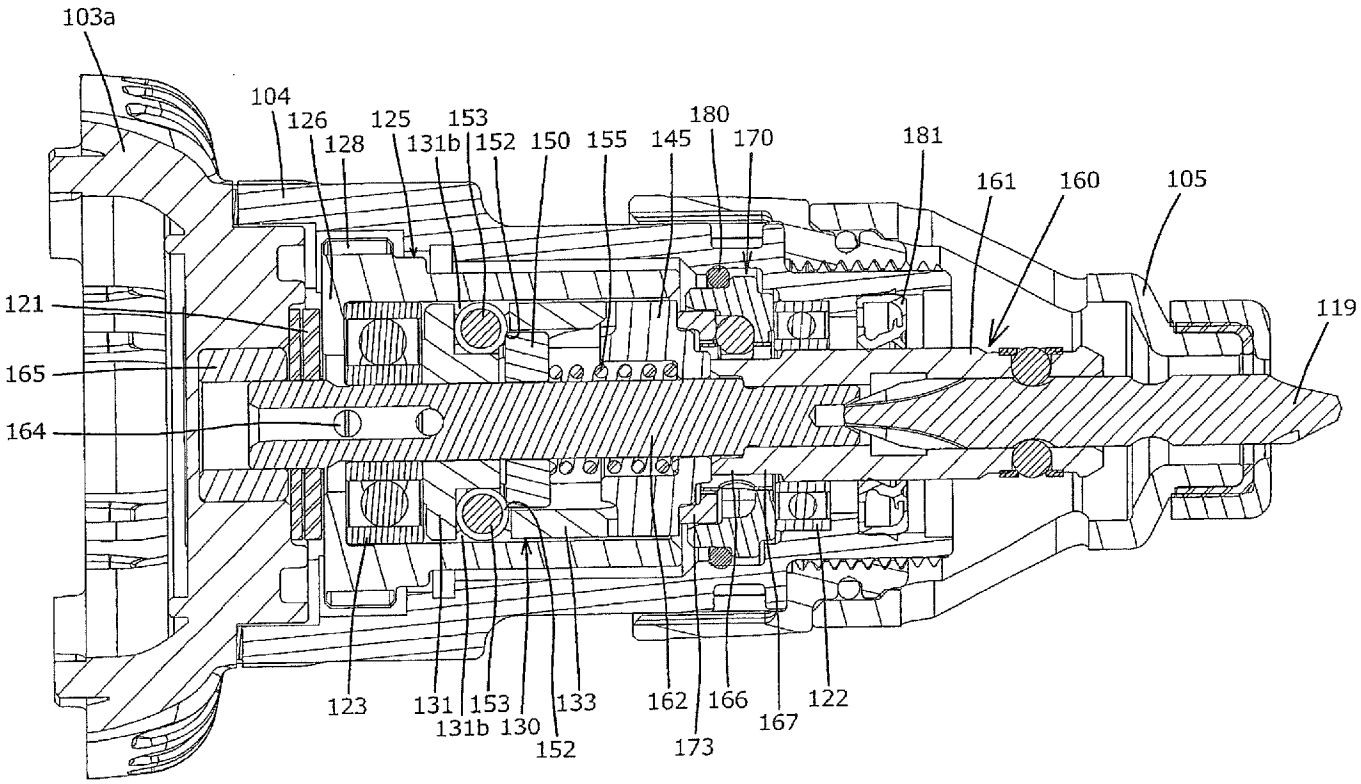
FIG. 5 is a sectional view taken along line V-V in FIG. 1.

As shown in FIGS. 4 and 5, the driving gear 125 is coaxially disposed with the spindle 160 which holds the tool bit 119. The driving gear 125 has a generally cup-like shape open to the front and having a bottom wall 126 and a side wall 127. A through hole is formed through the center of the bottom wall 126, and a rear shaft part 162 of the spindle 160 is inserted through the through hole. The side wall 127 defines a cylindrical internal space inside. The internal space of the driving gear 125 houses the retainer 130, the roller 140, the lock sleeve 145 and the coil spring 155. Gear teeth 128 are provided on the outer periphery of the side wall 127 and engage with gear teeth 112 formed in the output shaft 111 of the motor 110. The driving gear 125 is rotatably supported on the body 101 (the partition wall 103*a*) by a needle bearing 121 provided on the rear of the bottom wall 126.

(Retainer)

Figure 6:
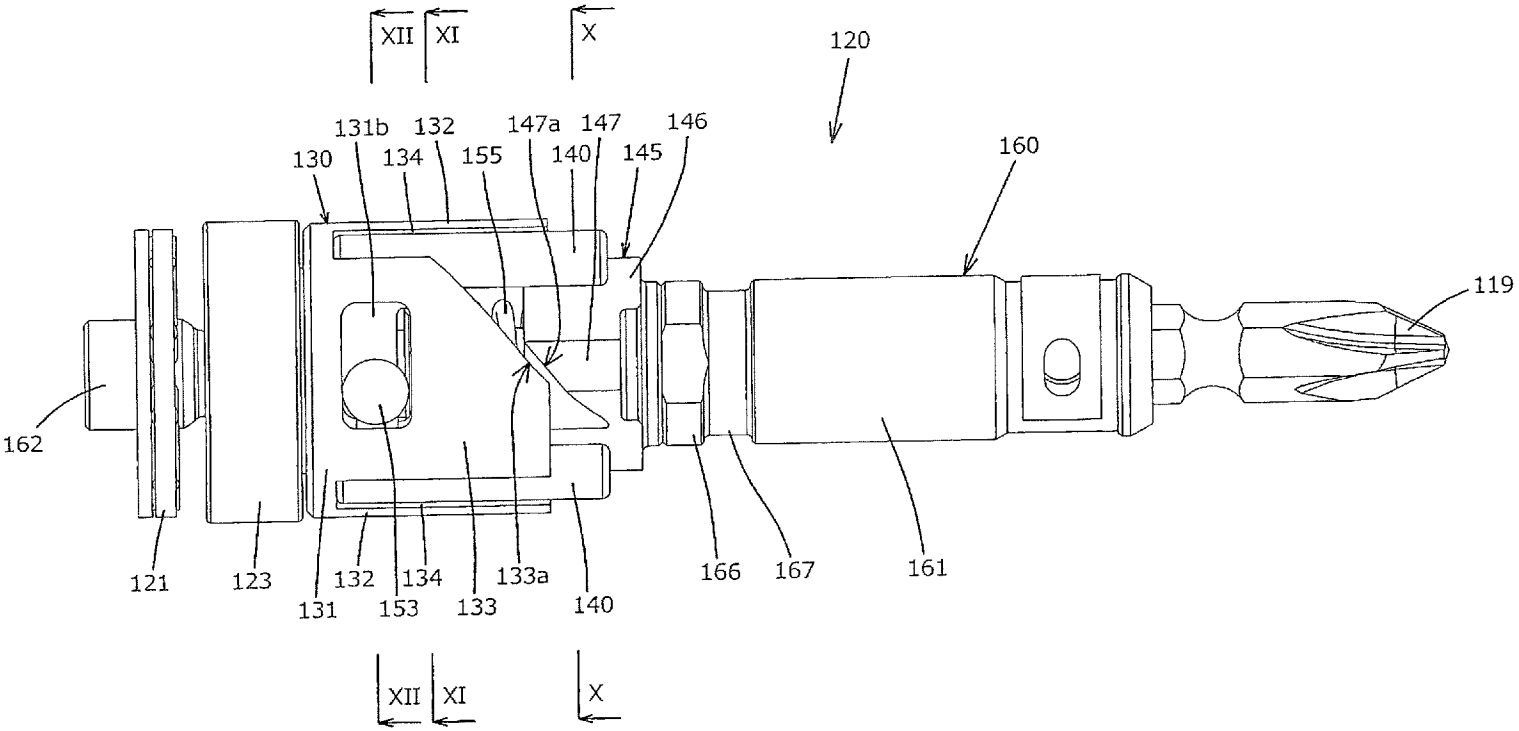
FIG. 6 is a side view of a driving mechanism.
Figure 7:
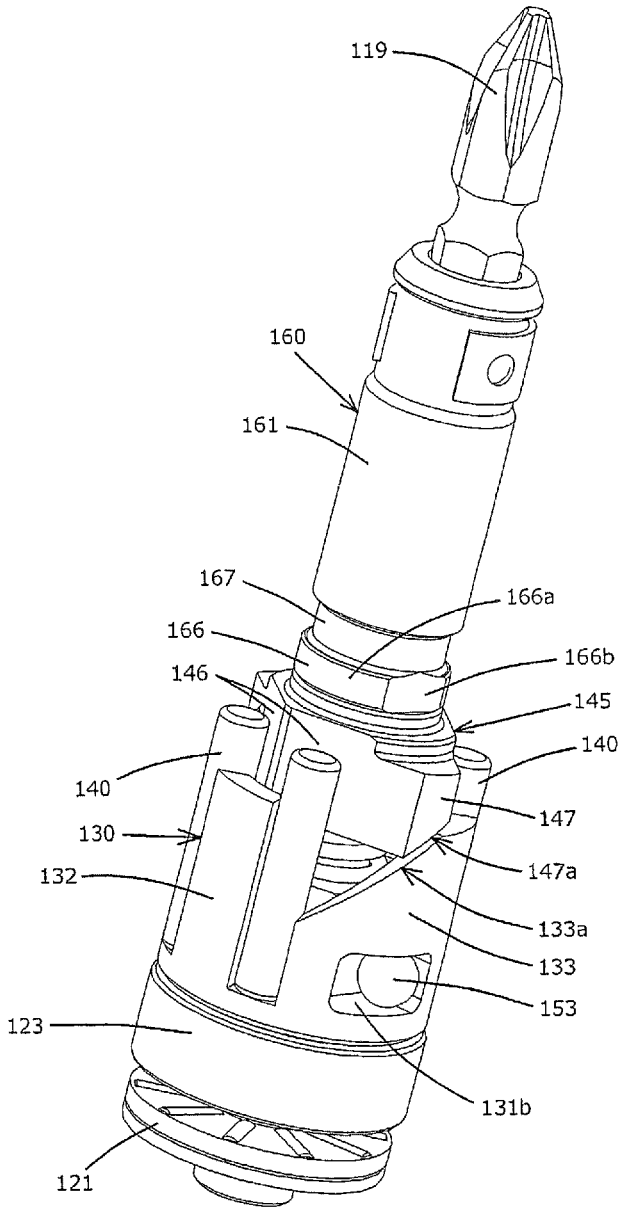
FIG. 7 is a perspective view of the driving mechanism.

As shown in FIGS. 4 to 8 and 9 to 12, the retainer 130 has a generally cup-like shape and is coaxially disposed with the driving gear 125. The retainer 130 has a base 131 facing the bottom wall 126 of the driving gear 125, and a first side wall 132 and a second side wall 133 facing the side wall 127 of the driving gear 125. In FIGS. 6 and 7, the driving gear 125 is not shown.

Figure 8:
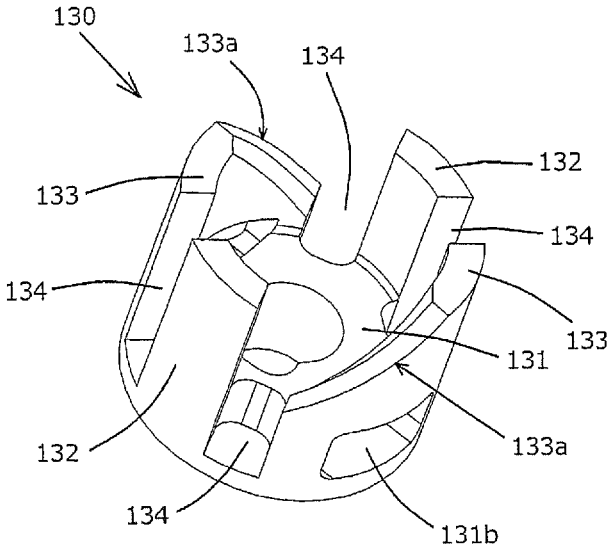
FIG. 8 is a perspective view of a retainer
Figure 12:
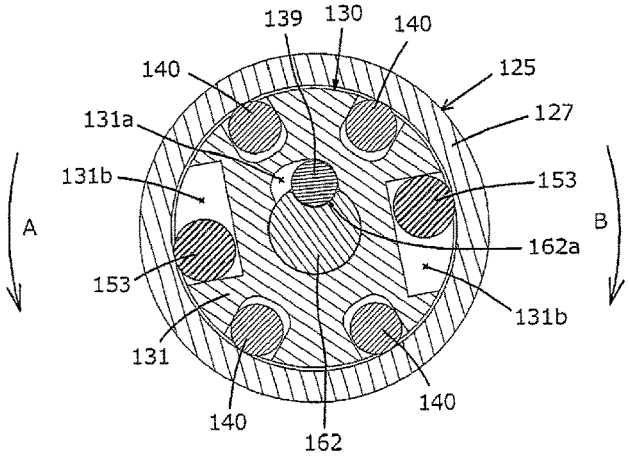
FIG. 12 is a sectional view taken along line XII-XII in FIG. 6.

As shown in FIGS. 4, 8 and 12, the base 131 has a through hole through which the rear shaft part 162 of the spindle 160 is inserted. As shown in FIG. 12, the through hole of the base 131 is an engagement hole 131*a* having a prescribed length in the circumferential direction of the spindle 160. As shown in FIG. 4, a groove 162*a* is formed in the rear shaft part 162 of the spindle 160 and extends in the axial direction of the spindle 160. As shown in FIG. 12, the groove 162*a* has a semi-circular section, in a direction perpendicular to the axial direction of the spindle 160, corresponding to a cylindrical shape of an engagement pin 139 for connecting the spindle 160 and the retainer 130. Therefore, within the range of the engagement hole 131*a* having a prescribed length in the circumferential direction of the spindle 160, the spindle 160 and the retainer 130 can rotate with respect to each other in engagement with the engagement pin 139.

Figure 11:
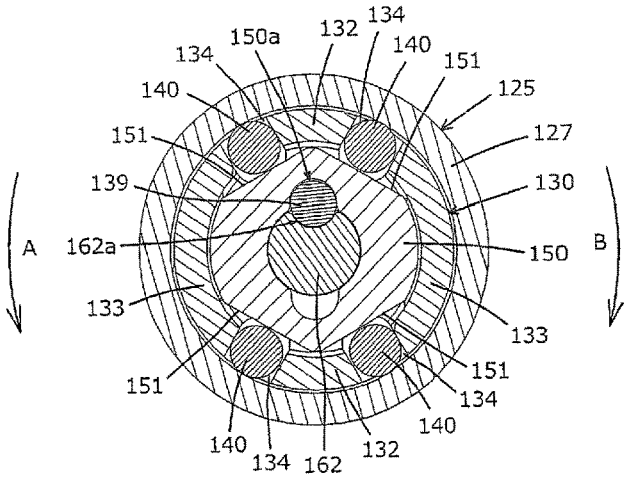
FIG. 11 is a sectional view taken along line XI-XI in FIG. 6.

As shown in FIGS. 4 to 8 and 11, the first and second side walls 132, 133 extend forward from the base 131 in the axial direction of the retainer 130. Each of a pair of such first side walls 132 and each of a pair of such second side walls 133 are respectively arranged to face the other across a center axis of the retainer 130. In other words, the second side walls 133 are arranged between the two first side walls 132. As shown in FIG. 11, a roller retaining part 134 for retaining a roller 140 is formed as a prescribed space between the first and second side walls 132, 133 in the circumferential direction of the retainer 130. Thus, the retainer 130 retains four rollers 140 between the first and second side walls 132, 133.

Further, as shown in FIGS. 6 to 8, the second side wall 133 has an inclined part 133*a* in the form of an inclined surface formed on its front end portion and inclined with respect to the rotation axis of the spindle 160 (the center axis of the retainer 130). The inclined parts 133*a* of the two second side walls 133 are formed in a point symmetry with respect to the center axis of the retainer 130. In other words, the two inclined parts 133*a* are configured as a lead surface extending along the circumferential direction of the retainer 130 and inclined at the same angle with respect to a contour line (outer periphery) of the retainer 130 in a cross section orthogonal to the axial direction of the retainer 130. Specifically, the two inclined parts 133*a* are configured and arranged in a double spiral shape.

Further, as shown in FIGS. 5, 6 and 12, the base 131 has ball retaining parts 131*b* formed in regions corresponding to the two second side walls 133. The two ball retaining parts 131*b* are formed in a point symmetry with respect to the center axis of the retainer 130. The ball retaining parts 131*b* are formed each as a groove having a depth greater than the thickness of the second side walls 133 in a radial direction of the retainer 130. Thus, as shown in FIG. 5, the outside and inside of the retainer 130 communicate with each other through the ball retaining parts 131*b* in the radial direction of the retainer 130.

As shown in FIG. 12, the ball retaining part 131*b* is configured such that its groove depth, or distance from the outer peripheral surface of the retainer 130 toward a center of the retainer 130 in the radial direction of the retainer 130 in the ball retaining part 131*b*, gradually decreases along the circumferential direction of the retainer 130. Specifically, the groove depth of the ball retaining part 131*b* is set to gradually decrease in the clockwise direction (in a direction B) shown by arrow B in FIG. 12. A ball 153 is disposed in each of the ball retaining parts 131*b*. When the ball 153 is located in a shallow region of the ball retaining part 131*b*, the ball 153 is disposed in contact with both the bottom (wall on the center side) of the ball retaining part 131*b* and the inner circumferential surface of the driving gear 125. On the other hand, when the ball 153 is located in a deep region of the ball retaining part 131*b*, the ball 153 gets in contact with only at least one of the bottom of the ball retaining part 131*b* and the inner circumferential surface of the driving gear 125.

(Lock Sleeve)

As shown in FIGS. 4 to 7, 9 and 10, the lock sleeve 145 has a generally hexagonal shape having a hollow part inside. The lock sleeve 145 is disposed coaxially with the retainer 130 and the driving gear 125 in front of the retainer 130. The lock sleeve 145 is arranged such that its front end can get in contact with a rear end of a front shaft part 161 of the spindle 160. The lock sleeve 145 has four roller engagement parts 146 for engagement with the rollers 140 and two retainer engagement parts 147 for engagement with the second side walls 133 of the retainer 130, corresponding to the six sides of the hexagon of the lock sleeve 145.

Figure 10:
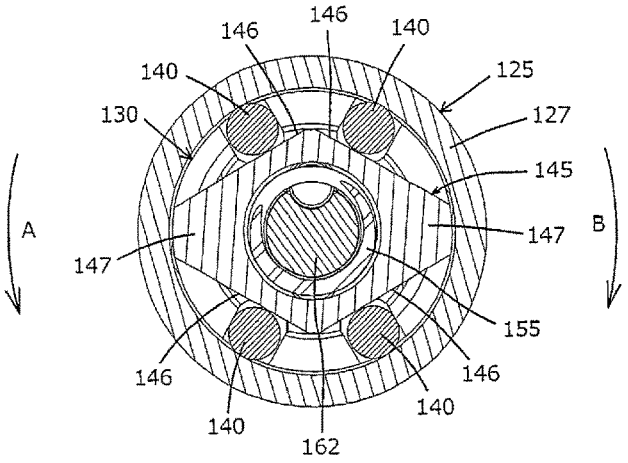
FIG. 10 is a sectional view taken along line X-X in FIG. 6.

As shown in FIG. 10, the roller engagement parts 146 are formed by four flat surfaces parallel to the rotation axis of the spindle 160 (the center axis of the lock sleeve 145). The two opposite surfaces of the roller engagement parts 146 are parallel to each other. The roller engagement parts 146 are configured to engage (contact) with the rollers 140 inside the first and second side walls 132, 133 in the radial direction of the retainer 130.

Figure 9:
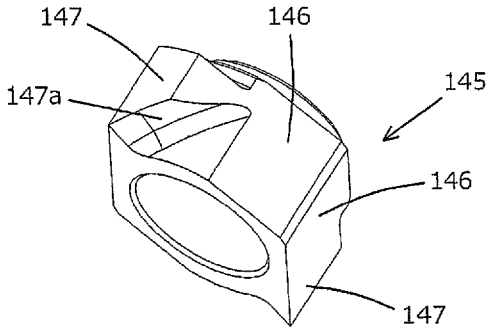
FIG. 9 is a perspective view of a lock sleeve.

Further, as shown in FIG. 10, the retainer engagement parts 147 are formed in a region at substantially the same distance as the radius of the retainer 130 away from the center axis of the lock sleeve 145 in the radial direction of the retainer 130. As shown in FIGS. 6, 7 and 9, the inclined part 147*a* is formed on the rear end of the retainer engagement part 147 in the axial direction by an inclined surface inclined with respect to the rotation axis of the spindle 160 (the center axis of the lock sleeve 145). The inclined part 147*a* is formed to correspond to the inclined part 133*a* of the second side wall 133. Specifically, the inclined part 147*a* can engage (contact) with the inclined part 133*a*. Therefore, like the inclined parts 133*a*, the two inclined parts 147*a* are formed in point symmetry with respect to the center axis of the lock sleeve 145. In other words, the two inclined parts 147*a* are configured as a lead surface extending along the circumferential direction around the axis of the lock sleeve 145 and inclined at the same angle with respect to a contour line (outer periphery) of the retainer engagement part 147 in a cross section orthogonal to the axial direction of the lock sleeve 145. Specifically, the two inclined parts 147*a* are configured to form a shape of a double helix.

(Spring Receiver)

As shown in FIGS. 4, 5 and 11, the spring receiver 150 has a generally orthogonal section and is disposed inside the retainer 130. The spring receiver 150 is disposed between the base 131 of the retainer 130 and the lock sleeve 145 in the axial direction. The spring receiver 150 has a through hole through which the spindle 160 is inserted. The engagement pin 139 disposed in the groove 162*a* of the rear shaft part 162 engages with a semi-circular engagement hole 150*a* of the spring receiver 150, so that the spring receiver 150 is connected to the spindle 160 so as to rotate together with the spindle 160. The spring receiver 150 has four roller engagement parts 151 on the outer periphery, corresponding to four of the six sides of the hexagon of the spring receiver 150. The roller engagement parts 151 are configured as flat surfaces parallel to the rotation axis of the spindle 160.

Further, as shown in FIG. 5, a ball contact part 152 is formed in a rear surface of the spring receiver 150. The ball contact part 152 gets in contact with a region of the ball 153 which is located toward the rotation axis of the retainer 130 (the rotation axis of the spindle 160) with respect to the center of the ball 153 in the radial direction of the retainer 130 and acts to push out the ball 153 outward in the radial direction of the spindle 160. The ball contact part 152 may be configured as an inclined surface inclined with respect to the axial direction of the spindle 160. The ball 153 pushed outward in the radial direction of the spindle 160 gets in contact with the inner circumferential surface of the driving gear 125. Therefore, the ball 153 moves within the ball retaining part 131*b* by rotation of the driving gear 125.

(Spindle)

As shown in FIGS. 4 to 7 and 10 to 12, the spindle 160 is a generally cylindrical, elongate member made of metal and is disposed to be movable in the axial direction of the spindle 160 (the axial direction of the tool bit 119). The spindle 160 mainly includes the front shaft part 161 and the rear shaft part 162 integrally connected to the front shaft part 161. The tool bit 119 is detachable coupled to the front shaft part 161. A leaf spring is held on the front shaft part 161 and biases a ball. The tool bit 119 engages with the ball and is thereby held by the front shaft part 161. The front shaft part 161 is rotatably supported by a front bearing 122 held by the front housing 104. Further, as shown in FIGS. 4 and 5, an oil seal 181 is disposed between the front housing 104 and the front shaft part 161 in front of the front bearing 122 which supports the front shaft part 161.

The rear shaft part 162 is coaxially connected to the front shaft part 161. The rear end of the rear shaft part 162 is supported so as to be rotatable and slidable in the axial direction with respect to a cylinder-like rear end bearing 165 provided in the partition wall 103*a* of the main housing 103. The rear end bearing 165 is configured as an oilless bearing. Thus, the spindle 160 is supported by the front bearing 122 and the rear end bearing 165. The rear shaft part 162 is inserted through the driving gear 125, the retainer 130 and the lock sleeve 145, and the rear end of the rear shaft part 162 protrudes rearward from the driving gear 125. The rear shaft part 162 has the groove 162*a* extending in the direction of the rotation axis of the spindle 160. When the rear end of the groove 162*a* is engaged with the engagement pin 139, the spindle 160 is prevented from moving forward in the axial direction. Further, the engagement pin 139 gets into contact with the rear end of the coil spring 155 and is prevented from moving forward in the axial direction of the spindle 160.

Figure 16:
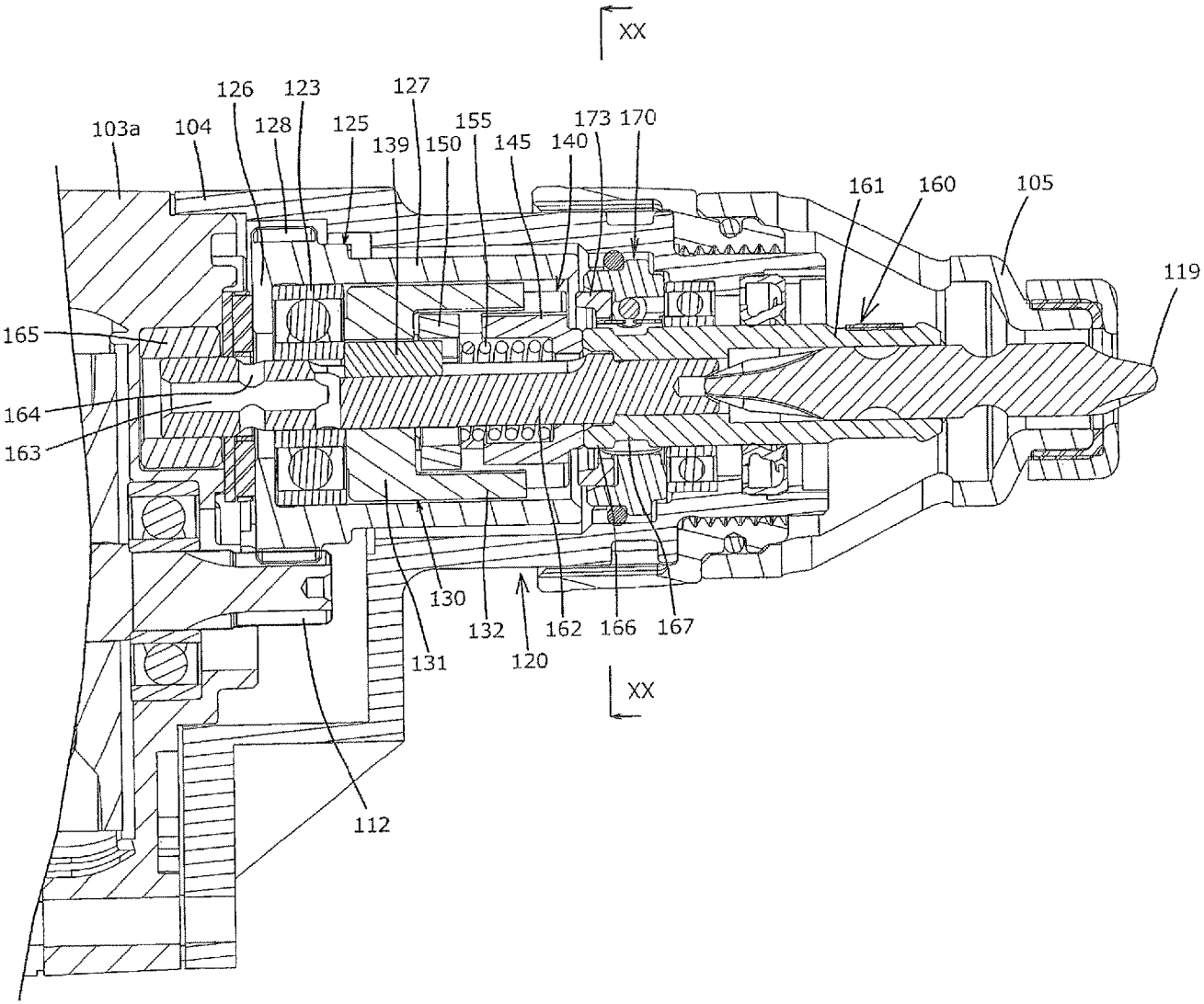
FIG. 16 is a sectional view corresponding to FIG. 4 and showing a state during screw tightening operation.

The rear shaft part 162 has a hollow part 163 open to a rear end surface of the rear shaft part 162 and extending inside the spindle 160 in the axial direction. Thus, the hollow part 163 communicates with the inside of the rear end bearing 165. Further, the rear shaft part 162 has a communication hole 164 formed through the rear shaft part 162 in the radial direction so as to provide communication between the hollow part 163 and the inside of the front housing 104. Thus, the inside of the front housing 104 and the inside of the rear end bearing 165 communicate with each other through the hollow part 163. With such a structure, when the spindle 160 moves rearward as shown in FIG. 16, compression of air inside the rear end bearing 165 is prevented. In other words, by provision of the communication hole 164, air inside the rear end bearing 165 is not compressed, so that rearward movement of the spindle 160 is not hindered.

Figure 15:
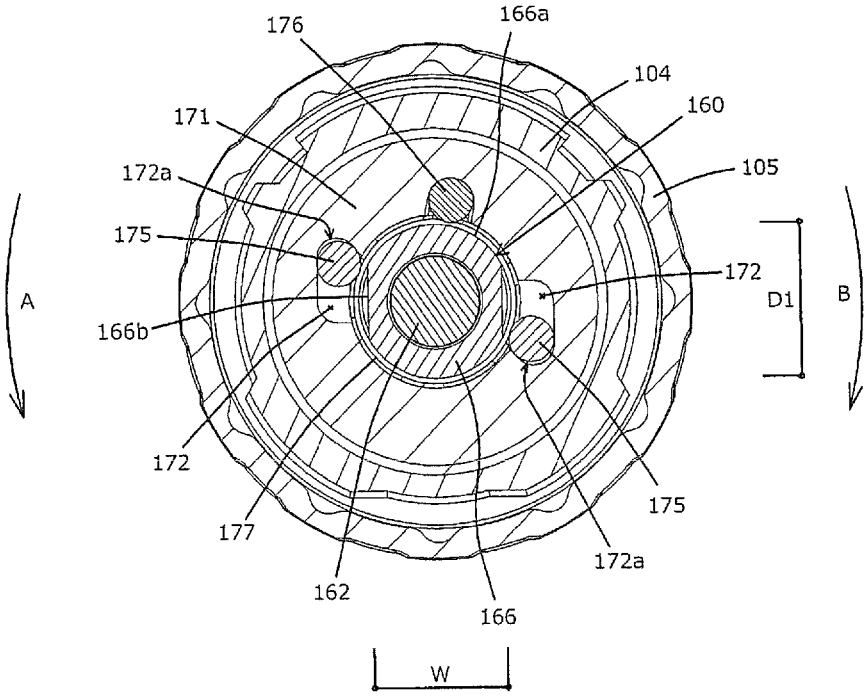
FIG. 15 is a sectional view taken along line XV-XV in FIG. 4.
Figure 20:
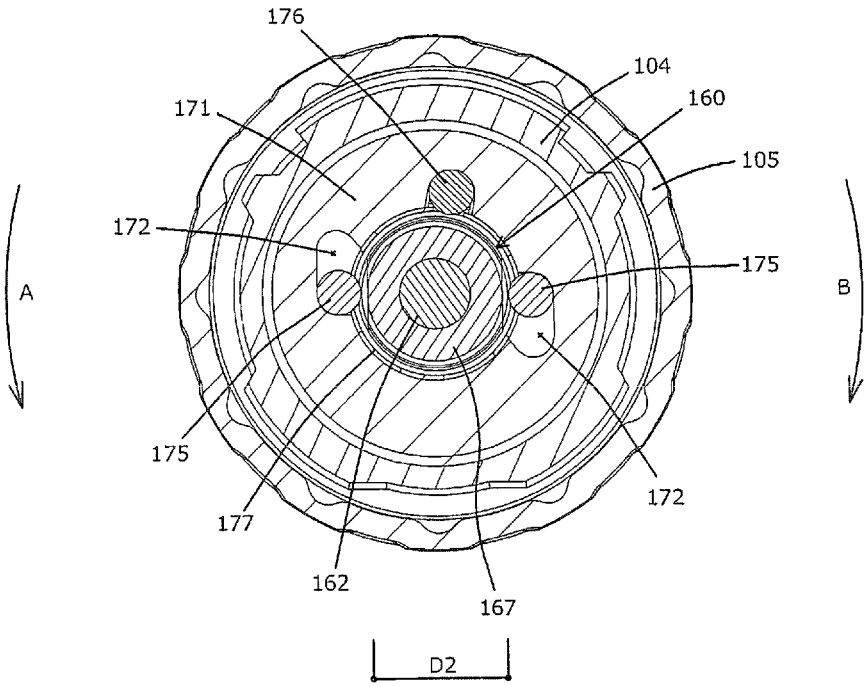
FIG. 20 is a sectional view taken along line XX-XX in FIG. 16.

Further, as shown in FIGS. 4 and 5, the front shaft part 161 has a rear end portion having a large-diameter part 166 which can engage with a stopper 170 and a small-diameter part 167 which cannot engage with the stopper 170. As shown in FIG. 15, the large-diameter part 166 has a circular arc part 166*a* having a diameter D1 and a width across flat part 166*b* having a width W. As shown in FIG. 20, the small-diameter part 167 has a circular shape having a diameter D2. The diameter D2 is equal to the width W of the width across flat part 166*b*.

(Coil Spring)

As shown in FIGS. 4 and 5, the coil spring 155 is coaxially disposed with the spindle 160 such that the spindle 160 is inserted therethrough. A front region of the coil spring 155 is disposed within the hollow part of the lock sleeve 145 and the front end of the coil spring 155 is held in contact with the lock sleeve 145. Further, the rear end of the coil spring 155 is held in contact with the front surface of the spring receiver 150. Thus, the coil spring 155 biases the lock sleeve 145 and the spindle 160 forward. The lock sleeve 145 biased forward biases the spindle 160 and gets into contact with the stopper 170 so that the lock sleeve 145 is prevented from moving further forward. Further, the coil spring 155 biases the spring receiver 150, the ball 153, the retainer 130 and the driving gear 125 rearward. As shown in FIG. 5, the ball 153 is biased by the coil spring 155, pushed outward in the radial direction of the retainer 130 via the ball contact part 152 of the spring receiver 150 and brought into contact with the inner circumferential surface of the driving gear 125. The ball 153 and the coil spring 155 are example embodiments that correspond to the "biased member" and the "biasing member", respectively, according to this invention.

(Stopper)

Figure 13:
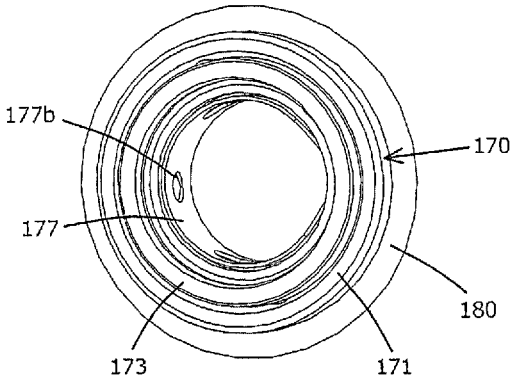
FIG. 13 is a perspective view of a stopper.
Figure 14:
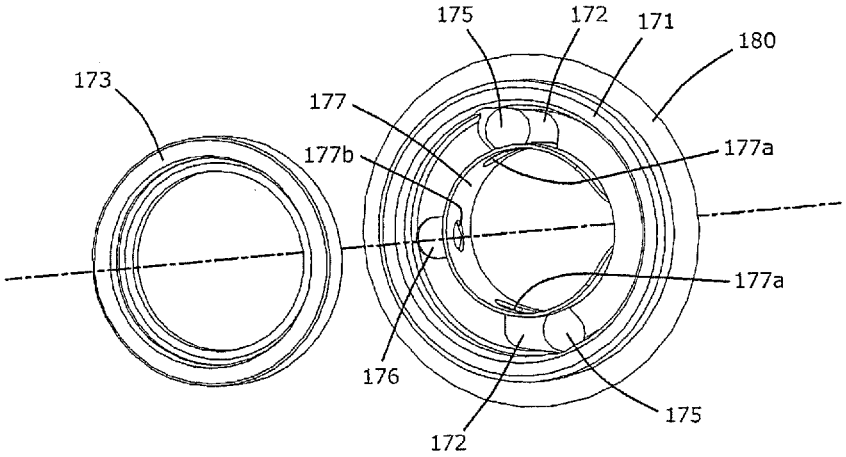
FIG. 14 is an exploded view of the stopper.

As shown in FIGS. 4 and 5, the stopper 170 forms a rotation preventing mechanism which prevents the spindle 160 from rotating in a prescribed direction when the spindle 160 is located in a front position. The stopper 170 is ring-shaped and fitted onto the spindle 160 such that the spindle 160 is inserted therethrough. The stopper 170 is fixed to the front housing 104 by an O-ring 180 which is disposed between the stopper 170 and the front housing 104. As shown in FIGS. 13 to 15, the stopper 170 mainly includes a ball retaining ring 171, a push ring 173, a ball 175 and a leaf spring 177.

As shown in FIGS. 13 and 14, the ball retaining ring 171 is a metal ring-like member and retains the ball 175 which can engage with the spindle 160. As shown in FIGS. 14 and 15, the ball retaining ring 171 has two retaining grooves 172 extending along the circumferential direction. Each of the retaining grooves 172 retains the ball 175 such that the ball 175 can move in the circumferential direction of the ball retaining ring 171. The retaining groove 172 is configured such that its groove depth, or distance from the inner circumferential surface of the ball retaining ring 171 to the bottom of the retaining groove 172 in the radial direction of the ball retaining ring 171 gradually increases along the circumferential direction of the ball retaining ring 171. Specifically, the depth (length in the radial direction) of the retaining groove 172 is set to gradually increase in a direction B (screw removing direction) shown by arrow B in FIG. 15. Further, a pocket-like region 172*a* is formed in a front portion of the retaining groove 172 in the direction B. When the ball 175 moves in the direction B within the retaining groove 172, the ball 175 abuts on a wall. The wall extends in a prescribed radial direction of the ball retaining ring 171 and forms the pocket-like region 172*a* in the retaining groove 172. Therefore, when the ball 175 is located in a position (the pocket-like region 172*a*) shown in FIG. 15, the ball 175 is held in the pocket-like region 172*a* and thereby prevented from moving toward the center of the ball retaining ring 171 in the radial direction (toward the rotation axis of the spindle 160).

A generally C-shaped leaf spring 177 is disposed on the inner circumferential part of the ball retaining ring 171. As shown in FIG. 14, the leaf spring 177 has two through holes 177*a* formed corresponding to the two retaining grooves 172. Part of each ball 175 protrudes toward the center of the ball retaining ring 171 through the through hole 177*a*. Specifically, the diameter of the ball 174 is larger than the depth of the retaining groove 172. Therefore, the leaf spring 177 serves as a dropping-out prevention member for preventing the ball 175 from dropping out of the retaining groove 172 to the center of the ball retaining ring 171 in the radial direction of the ball retaining ring 171. With this structure, the amount of protrusion of the ball 175 from the through hole 177*a* of the leaf spring 177 varies according to the position of the ball 175 within the retaining groove 172.

Further, as shown in FIGS. 13 and 14, the leaf spring 177 has an engagement hole 177*b* which engages with a ball 176 held by the ball retaining ring 171. With the leaf spring 177 fitted on the inner circumferential part of the ball retaining ring 171, the ball 176 is fitted in the ball retaining ring 171 by utilizing elastic deformation of the leaf spring 177, and thereafter, the balls 175 are fitted in the retaining grooves 172. In this manner, the ball retaining ring 171, the balls 175 and the leaf spring 177 are integrally assembled together. The retaining grooves 172 are open to the rear and the balls 175 are put into the retaining grooves 172 from behind the ball retaining ring 171. The ball 176 is fitted into the ball retaining ring 171 from front and engaged with the engagement hole 177*b* of the leaf spring 177. The ball retaining ring 171 has a retaining hole for retaining the ball 176 so as to prevent the ball 176 engaged with the leaf spring 177 from moving rearward of the ball retaining ring 171. The balls 175 and the ball 176 which are prevented from moving forward and rearward, respectively, in engagement with the ball retaining ring 171, and the leaf spring 177 are associated with each other to form an assembly of the components of the stopper 170. As a result, the stopper 170 can be easily mounted to the front housing 104.

As shown in FIGS. 13 and 14, the push ring 173 is a ring-like member having a smaller diameter than the ball retaining ring 171 and disposed coaxially with the ball retaining ring 171 within the ball retaining ring 171. The front end surface of the push ring 173 is held in contact with the balls 175 held by the ball retaining ring 171. The push ring 173 can rotate with respect to the ball retaining ring 171. The rear end surface of the push ring 173 can come in contact with or separate from a shoulder part of the lock sleeve 145 which is offset rearward from the front end surface of the lock sleeve 145. Specifically, as shown in FIG. 5, when the lock sleeve 145 is biased by the coil spring 155 and located in a front position, the lock sleeve 145 comes in contact with the push ring 173. On the other hand, as shown in FIG. 16, when the lock sleeve 145 is located in a rear position, the lock sleeve 145 separates from the push ring 173.

In the above-described stopper 170, when the lock sleeve 145 located in the front position in contact with the push ring 173 is rotated, the push ring 173 comes in contact with the ball 175 and the ball 175 moves within the retaining groove 172. Thus, the amount of protrusion of the ball 175 from the retaining groove 172 varies in the radial direction of the ball retaining ring 171. Specifically, when the ball 175 moves in the direction A (screw tightening direction) as shown in FIG. 20, the amount of protrusion of the ball 175 from the leaf spring 177 increases. On the other hand, when the ball 175 moves in the direction B (screw removing direction) as shown in FIG. 15, the amount of protrusion of the ball 175 from the leaf spring 177 decreases. Specifically, when the ball 175 is moved in the circumferential direction of the spindle 160, the ball 175 moves between a position away from the center axis of the spindle 160 as shown in FIG. 15 (also referred to as a separate position) and a position closer to the center axis of the spindle 160 as shown in FIG. 20 (also referred to as a proximity position).

When the ball 175 is located in the separate position, the ball 175 does not engage with the large-diameter part 166 and the small-diameter part 167 of the spindle 160. Thus, in the separate position, the ball 175 cannot engage with the spindle 160. Therefore, the separate position may also be referred to as an unengageable position. When the ball 175 is located in the proximity position, the ball 175 can engage with the large-diameter part 166 of the spindle 160. Specifically, when the ball 175 is located in the proximity position and the spindle 160 is located in the front position where the large-diameter part 166 of the spindle 160 faces the ball 175, the ball 175 engages with the spindle 160. On the other hand, when the spindle 160 is located in the rear position where the small-diameter part 167 of the spindle 160 faces the ball 175, the ball 175 does not engage with the spindle 160. Therefore, in the proximity position, the ball 175 can engage with the spindle 160. Therefore, the proximity position may also be referred to as an engageable position. The ball 175 is switched from the unengageable position to the engageable position by movement of the ball 175 in the screw tightening direction, while the ball 175 is switched from the engageable position to the unengageable position by movement of the ball 175 in the screw removing direction.

(Operation of Screwdriver)

In the screwdriver 100 having the above-described structure, the motor 110 is driven when the trigger 107*a* is operated. The driving gear 125 is rotationally driven by rotation of the output shaft 111 of the motor 110. When the rotation of the driving gear 125 is transmitted to the spindle 160, the tool bit 119 held by the spindle 160 is rotated and performs a prescribed operation (screw tightening operation or screw removing operation). The spindle 160 is an example embodiment that corresponds to the "tool accessory holding shaft" according to this embodiment.

(Screw Tightening Operation)

When performing a screw tightening operation, a screw (not shown) on the tip of the tool bit 119 is pressed against a workpiece. At this time, the spindle 160 is moved from the front position shown in FIG. 4 to the rear position shown in FIG. 16. The front position and the rear position are example embodiments that correspond to the "first position" and the "second position", respectively, according to this invention. By this movement of the spindle 160, the lock sleeve 145 is rotated with respect to the retainer 130 and the rollers 140 are held between the driving gear 125 and the lock sleeve 145. As a result, the driving gear 125 and the lock sleeve 145 rotate together by the wedge effect of the rollers 140, so that the rotation of the output shaft 111 of the motor 110 is transmitted to the spindle 160 via the driving mechanism 120. Thus, the spindle 160 is rotationally driven and the tool bit 119 performs a screw tightening operation. The roller 140 is an example embodiment that corresponds to the "intervening member" according to this embodiment. The lock sleeve 145 and the spindle 160 form the "tool accessory driving shaft" according to this invention.

Specifically, when the spindle 160 is located in the front position as shown in FIG. 4, the driving gear 125 is rotationally driven in the direction A in FIGS. 10 to 12 if the output shaft 111 of the motor 110 is rotated in a prescribed direction (hereinafter referred to as normal direction). At this time, the rollers 140 are not held between the driving gear 125 and the lock sleeve 145, so that the rotation of the driving gear 125 is not transmitted to the lock sleeve 145. Further, as shown in FIG. 12, by the rotation of the driving gear 125 in the direction A, the ball 153 comes in contact with the inner circumferential surface of the driving gear 125 and moves in the direction A within the ball retaining part 131*b*. At this time, however, the depth (length in the radial direction) of the ball retaining part 131*b* is deep enough that the ball 153 is not held between the ball retaining part 131*b* and the driving gear 125. Specifically, the ball 153 is loosely held within the ball retaining part 131*b*, so that the rotation of the driving gear 125 is not transmitted to the retainer 130. This state is also referred to as an idling state.

Figure 17:
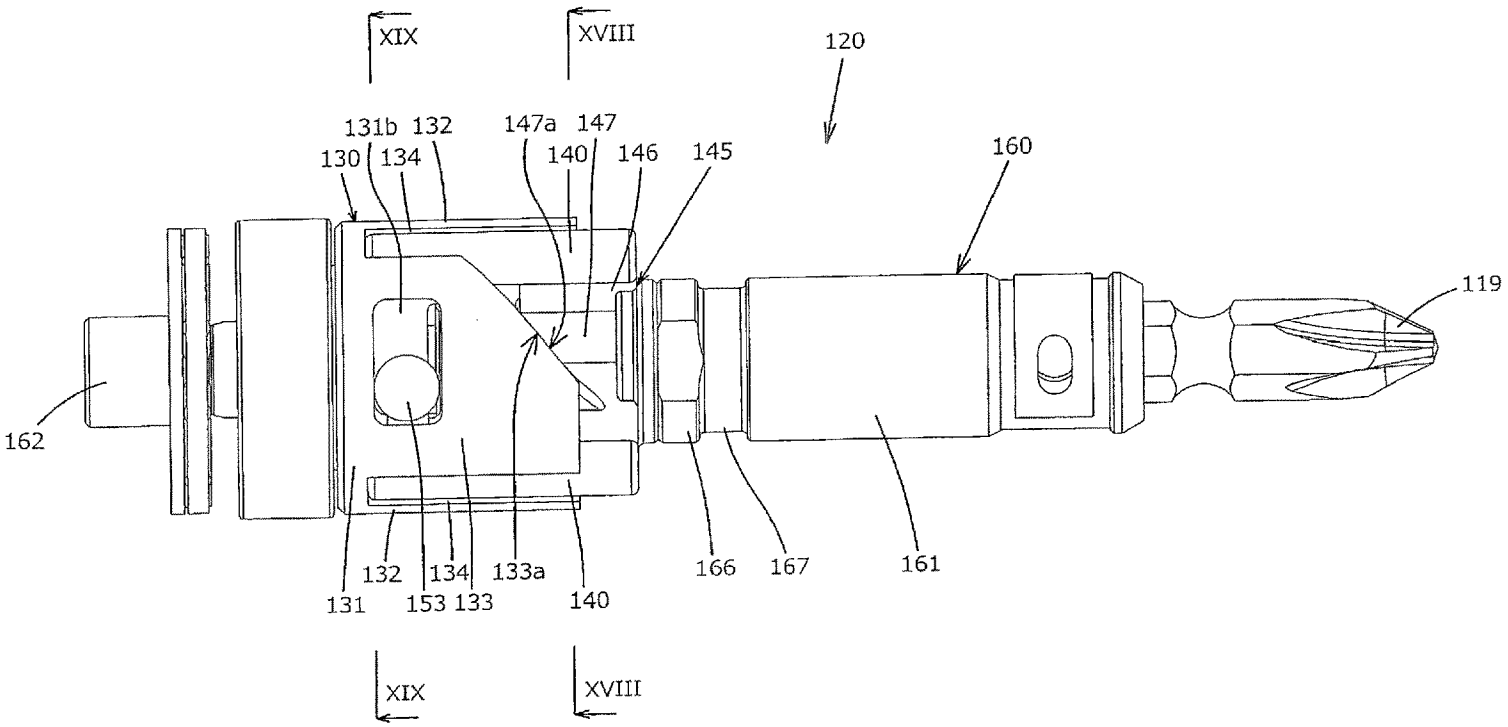
FIG. 17 is a side view corresponding to FIG. 6 and showing the state during screw tightening operation.
Figure 18:
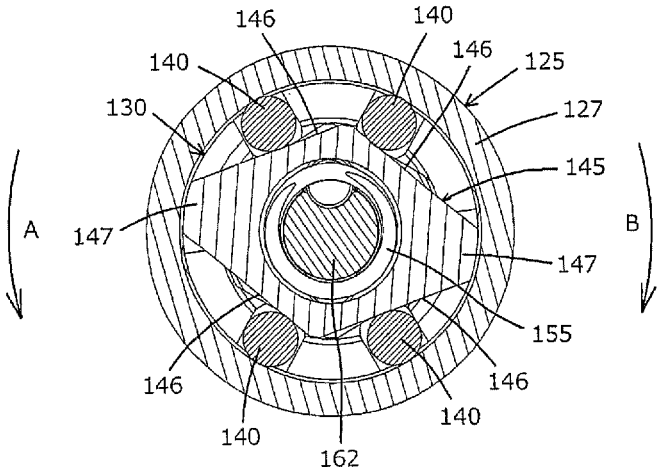
FIG. 18 is a sectional view taken along line XVIII-XVIII in FIG. 17.

When the screw held on the tip of the tool bit is pressed against the workpiece in the idling state, the spindle 160 is moved from the front position shown in FIG. 4 to the rear position shown in FIG. 16 against the biasing force of the coil spring 155. As a result, the lock spring 145 is pushed rearward by the rear end of the front shaft part 161 of the spindle 160, and the retainer engagement part 147 of the lock sleeve 145 comes in contact with the second side wall 133 of the retainer 130. Specifically, as shown in FIG. 17, the inclined part 147*a* of the retainer engagement part 147 and the inclined part 133*a* of the second side wall 133 come in contact with each other. The inclined part 147*a* moves along the inclined part 133*a*, so that the lock sleeve 145 moves rearward and rotates around the axis of the retainer 130. Specifically, as shown in FIG. 18, the lock sleeve 145 rotates at a prescribed angle in the direction B around the rotation axis of the spindle 160 with respect to the retainer 130. As a result, the distance between the roller engagement part 146 of the lock sleeve 145 and the inner circumferential surface of the driving gear 125 is shortened, so that the roller 140 is held between the roller engagement part 146 and the inner circumferential surface of the driving gear 125. Thus, the roller 140 acts as a wedge and the driving gear 125 and the lock sleeve 145 are integrated via the roller 140. The position (shown in FIG. 18) of the roller 140 which is held between the lock sleeve 145 and the driving gear 125 is also referred to as a rotation transmitting position. Therefore, the neutral position (shown in FIG. 10) of the roller 140 which is not held between the lock sleeve 145 and the driving gear 125 is also referred to as a rotation transmission disabled position. The lock sleeve 145 is an example embodiment that corresponds to the "first holding member" according to this invention.

At this time, as shown in FIG. 17, the inclined part 147*a* of the lock sleeve 145 is in contact with the inclined part 133*a* of the retainer 130. Therefore, as shown in FIG. 18, when the driving gear 125 is rotationally driven in the direction A by the output shaft 111 of the motor 110, the lock sleeve 145 integrated with the driving gear 125 is rotated. Thus, the inclined part 147*a* of the lock sleeve 145 presses the retainer 130 in the direction A and rotates the retainer 130 in the direction A.

Figure 19:
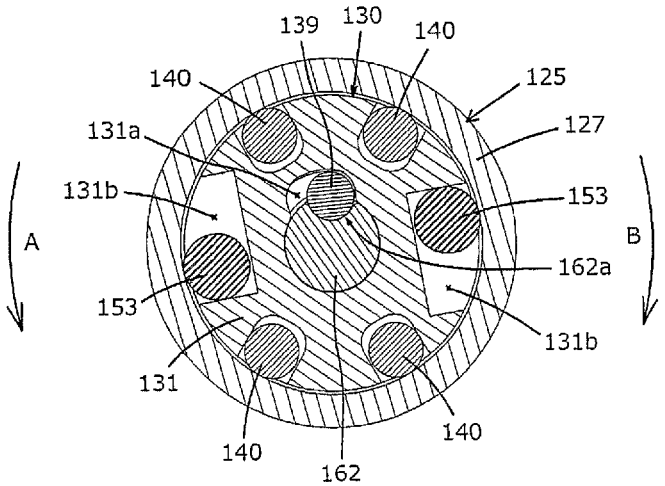
FIG. 19 is a sectional view taken along line XIX-XIX in FIG. 17.

As shown in FIG. 19, the retainer 130 rotated in the direction A rotates the spindle 160 in the direction A (screw tightening direction) via the engagement pin 139 which is engaged with the engagement hole 131*a* of the retainer 130. As a result, a screw tightening operation is performed by the tool bit 119 held by the spindle 160. Further, when the spindle 160 is located in the rear position as shown in FIG. 16, the small-diameter part 167 of the spindle 160 faces the ball 175 of the stopper 170. The ball 175 does not engage with the small-diameter part 167, so that rotation of the spindle 160 in the screw tightening direction is not hindered.

When the screw is screwed into the workpiece, the whole screwdriver 100 moves forward along with the movement of the screw, and the front surface of the locator 105 comes in contact with the workpiece. Thereafter, when the screw is further screwed into the workpiece, the spindle 160 holding the tool bit 119 moves forward in the screwdriver 100 with respect to the locator 105 (the front housing 104). Specifically, the spindle 160 is allowed to move from the rear position shown in FIG. 16 to the front position shown in FIG. 4. In other words, the spindle 160 is pressed until the locator 105 comes in contact with the workpiece, so that the spindle 160 and the locator 105 are prevented from moving with respect to each other in the direction of the rotation axis of the spindle 160.

The biasing force of the coil spring 155 acts forward upon the spindle 160 via the lock sleeve 145. Further, the lock sleeve 145 presses the retainer 130 and moves (rotates) the retainer 130 around the rotation axis of the spindle 160, so that the lock sleeve 145 receives reaction force from the retainer 130. Specifically, the inclined part 147*a* of the lock sleeve 145 and the inclined part 133*a* of the retainer 130 which are inclined with respect to the rotation axis of the spindle 160 are in contact with each other, so that the lock sleeve 145 receives reaction force in the direction of the rotation axis of the spindle 160 and reaction force around the rotation axis. The inclined part 147*a* is an example embodiment that corresponds to the "second inclined surface" and the "contact part" according to this invention. The inclined part 133*a* is an example embodiment that corresponds to the "inclined surface" according to this invention.

Therefore, during screw tightening operation, when the spindle 160 is allowed to move from the rear position to the front position after the locator 105 gets in contact with the workpiece, the lock sleeve 145 is moved forward from the position shown in FIG. 16 by the resultant (force in the direction of the rotation axis of the spindle 160) of the biasing force of the coil spring 155 and the reaction force from the retainer 130. Specifically, this resultant force exceeds the friction force between the rollers 140 and the lock sleeve 145. In other words, solely the biasing force of the coil spring 155 does not exceed the friction force between the rollers 140 and the lock sleeve 145, but the resultant of the biasing force of the coil spring 155 and the reaction force from the retainer 130 exceeds the friction force between the rollers 140 and the lock sleeve 145. Therefore, the lock sleeve 145 is not moved forward solely by the biasing force of the coil spring 155, but by the resultant of the biasing force of the coil spring 155 and the reaction force from the retainer 130. As a result, the lock sleeve 145 and the retainer 130 are separated from each other in the direction of the rotation axis of the spindle 160 and a clearance is formed between the lock sleeve 145 and the retainer 130. Thus, the lock sleeve 145 shown in FIG. 18 is rotated in the direction A with respect to the driving gear 125, so that the rollers 140 are released or disengaged from between the driving gear 125 and the lock sleeve 145. Specifically, the wedge action of the rollers 140 is released. Therefore, transmission of rotation from the driving gear 125 to the spindle 160 is interrupted so that the screw tightening operation is completed. The lock sleeve 145 is an example embodiment that corresponds to the "first element" according to this invention.

(Screw Removing Operation)

In a screw removing operation of removing a screw screwed into a workpiece, the screw is reversely rotated by the screwdriver 100 (the tool bit 119) to remove the screw from the workpiece. In the screw removing operation, it is not rational to press the tool bit 119 against the screw. Therefore, in the screw removing operation by the screwdriver 100, the tool bit 119 is driven by the motor 110 without being pressed. Specifically, the spindle 160 is located in the front position while the spindle 160 (the tool bit 119) is reversely rotated.

Specifically, as shown in FIG. 1, in the screw removing operation, the changeover switch 107*b* is switched such that the output shaft 111 of the motor 110 rotates in a direction opposite to the normal direction (hereinafter referred to as a reverse direction). Further, an LED 107*c* is provided in the vicinity of the changeover switch 107*b*. When the rotation direction of the output shaft 111 is switched to the reverse direction and the trigger 107*a* is operated, the LED 107*c* emits light. Specifically, the LED 107*c* informs the user that a screw removing operation is performed. When the output shaft 111 of the motor 110 rotates in the reverse direction, the driving gear 125 is rotated in the direction B in FIGS. 10 to 12. At this time, since the rollers 140 are not held between the lock sleeve 145 and the driving gear 125, the rotation of the driving gear 125 is not transmitted to the lock sleeve 145.

Figure 21:
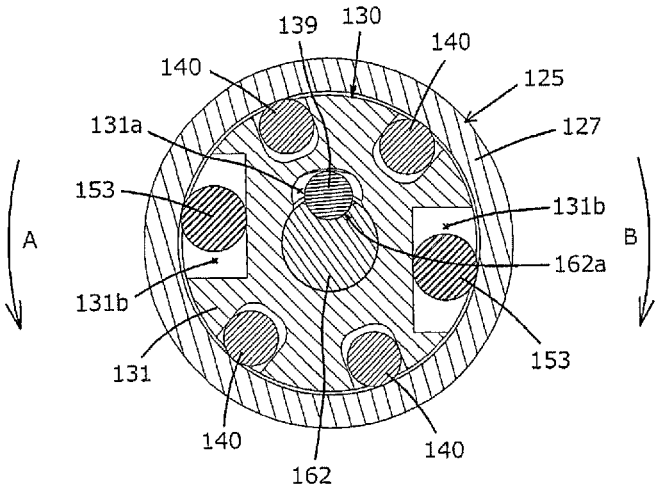
FIG. 21 is a sectional view corresponding to FIG. 12 and showing a state during screw removing operation.

By the rotation of the driving gear 125 in the direction B, the ball 153 shown in FIG. 12 moves in the direction B in contact with the inner circumferential surface of the driving gear 125 within the ball retaining part 131*b* and placed in a position shown in FIG. 21. Since the depth (length in the radial direction) of the ball retaining part 131*b* decreases in the direction B, the ball 153 is held between the ball retaining part 131*b* and the driving gear 125 by moving in the direction B within the ball retaining part 131*b*. As a result, the ball 153 acts as a wedge, so that the driving gear 125 and the retainer 130 are integrated via the ball 153.

Figure 22:
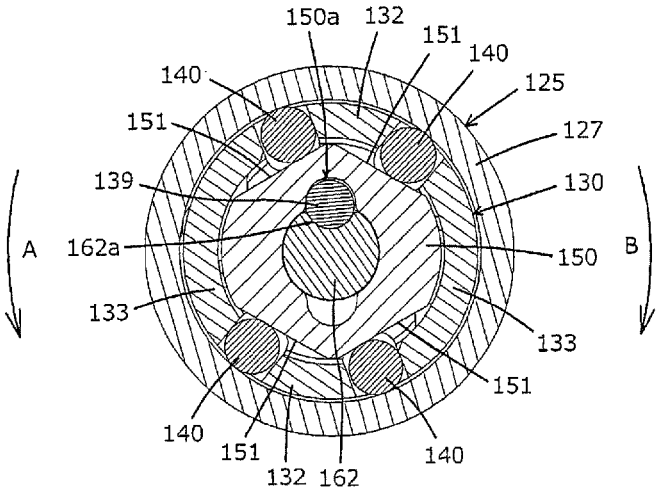
FIG. 22 is a sectional view corresponding to FIG. 11 and showing the state during screw removing operation.

As shown in FIG. 21, the engagement hole 131*a* of the retainer 130 has a prescribed length in the circumferential direction of the spindle 160 so that the spindle 160 and the retainer 130 are allowed to rotate with respect to each other. Further, as shown in FIG. 22, rotation of the spring receiver 150 with respect to the spindle 160 is prevented via the engagement pin 139. Therefore, when the retainer 130 is rotated in the direction B together with the driving gear 125, the retainer 130 rotates in the direction B with respect to the spindle 160 and the spring receiver 150, and thus the rollers 140 held by the retainer 130 are moved in the direction B. As a result, the rollers 140 are held between the spring receiver 150 and the driving gear 125 and act as a wedge, so that the driving gear 125, the spring receiver 150 and the spindle 160 are integrated via the rollers 140. Therefore, the spindle 160 is rotated in the direction B (screw removing direction) by rotation of the driving gear 125 in the direction B. As a result, a screw removing operation is performed by the tool bit 119 held by the spindle 160. The spring receiver 150 is an example embodiment that corresponds to the "second holding member" according to this invention.

In the above-described screwdriver 100, a screw tightening operation is performed when the spindle 160 is located in the rear position. Screws are mounted to the tip of the tool bit 119 one by one when performing the screw tightening operation. Therefore, when the spindle 160 is located in the front position in which the spindle 160 is not rotationally driven, it is preferred that the spindle 160 is securely stopped. Specifically, in an idling state, it is preferred that the spindle 160 is stopped or not moved around the rotation axis of the spindle 160. Therefore, in this embodiment, the stopper 170 is provided to prevent the spindle 160 from unintentionally rotating in the screw tightening direction when the spindle 160 is located in the front position. Further, the ball retaining ring 171 of the stopper 170 is fixed to the front housing 104 by the O-ring 180, so that rotation of the stopper 170 is prevented.

Figure 23:
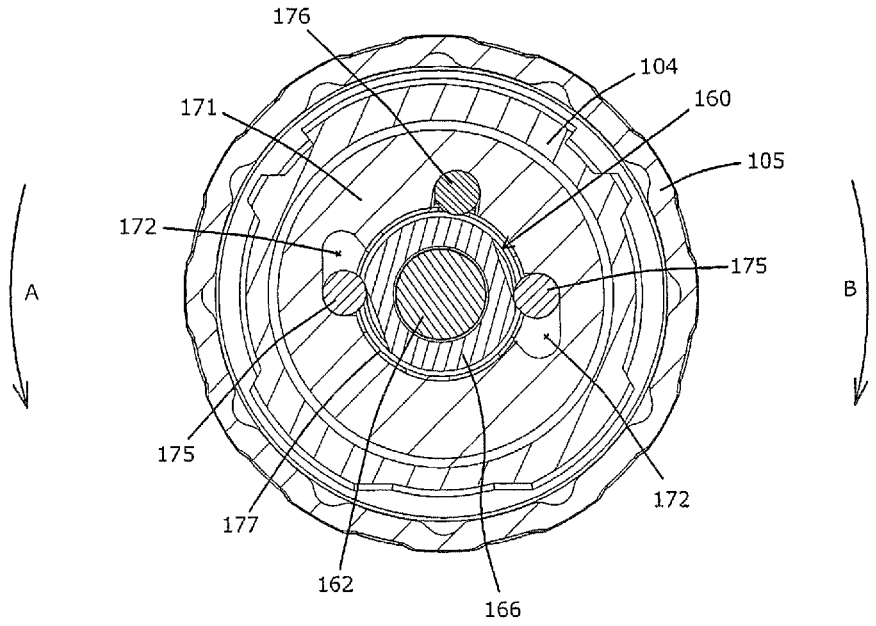
FIG. 23 is a sectional view corresponding to FIG. 15 and showing a state in which a spindle is prevented from rotating in a screw tightening direction by a stopper.

Specifically, as shown in FIG. 4, when the spindle 160 is located in the front position, the large-diameter part 166 of the spindle 160 faces the ball 175 of the stopper 170. At this time, even if the driving gear 125 is rotationally driven in the direction A, the lock sleeve 145 and the spindle 160 are not normally rotated. If the lock sleeve 145 is rotated for any reason, however, the ball 175 is moved within the retaining groove 172 in the direction A as shown in FIG. 20 via the push ring 173 by rotation of the driving gear 125 in the direction A (screw tightening direction), since the lock sleeve 145 is biased by the coil spring 155 and held in contact with the push ring 173. The depth (length in the radial direction) of the retaining groove 172 decreases in the direction A. When the ball 175 comes to a position shown in FIG. 20, the amount of protrusion of the ball 175 from the leaf spring 177 reaches its maximum. As a result, the large-diameter part 166 of the spindle 160 comes in contact with the ball 175, so that rotation of the spindle 160 in the direction A is prevented. Particularly, as shown in FIG. 23, the ball 175 engages with the width across flat part 166*b* of the large-diameter part 166, so that rotation of the spindle 160 in the direction A is prevented.

A screw removing operation is performed without pressing the tool bit held by the spindle 160 against a workpiece. Specifically, the screw removing operation is performed with the spindle 160 located in the front position. As shown in FIG. 4, when the spindle 160 is located in the front position, the large-diameter part 166 of the spindle 160 faces the ball 175 of the stopper 170. At this time, when the driving gear 125 is rotationally driven in the direction B, the ball 175 is moved within the retaining groove 172 in the direction B as shown in FIG. 15 via the push ring 173 by rotation of the driving gear 125 in the direction B (screw removing direction), since the lock sleeve 145 is biased by the coil spring 155 and held in contact with the push ring 173. The depth (length in the radial direction) of the retaining groove 172 increases in the direction B. When the ball 175 comes to a position shown in FIG. 15, the large-diameter part 166 of the spindle 160 does not come in contact with the ball 175. The stopper 170 serves to allow the spindle 160 to rotate in the screw removing direction when the spindle 160 is located in the front position. Therefore, in the screw removing operation, rotation of the spindle 160 in the direction B (screw removing direction) is not blocked by the ball 175.

Further, in the above-described screwdriver 100, as shown in FIG. 4, lubricant (not shown) such as grease is provided within the front housing 104 so as to smoothly drive the driving mechanism 120. Further, in order to prevent the lubricant from leaking out from the front of the front housing 104, the oil seal 181 is disposed between the outer periphery of the front shaft part 161 of the spindle 160 and the front housing 104 in a front region of the front housing 104. Thus, the front housing 104 is hermetically formed.

Figure 24:
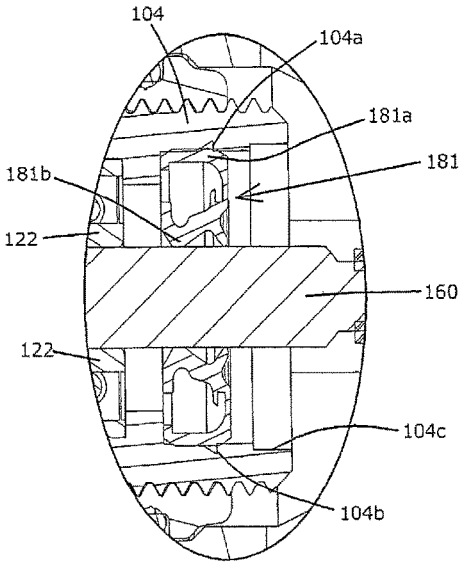
FIG. 24 is an enlarged partial view of an oil seal.

As shown in FIG. 24, the oil seal 181 has a ring-like shape and has a base 181*a* which is mounted on the front housing 104 and a lip 181*b* which is held in contact with the spindle 160. Particularly, the base 181*a* which is held in contact with the inner circumferential surface of the front housing 104 is made of elastomer. The front housing 104 has a large-diameter part 104*c* formed in the front end and having a slightly larger diameter than the outer diameter of the oil seal 181. Further, the outer diameter of the oil seal 181 is slightly larger than the inner diameter of the front housing 104. Further, the front housing 104 has an upper recess 104*a* and a lower recess 104*b* in the inner circumferential surface.

Particularly, a plurality of the recesses 104*a*, 104*b* are formed on the same circumference. The recesses may be configured as a single recess which is continuously formed in the circumferential direction, or a projection may be provided in place of the recess.

The above-described oil seal 181 is fitted into the front housing 104 from the front by elastic deformation of the outer periphery of the oil seal 181. At this time, the oil seal 181 is moved (inserted) along the large-diameter part 104*c* of the front housing 104. Specifically, the large-diameter part 104*c* serves as a guide when mounting the oil seal 181. Further, the base 181*a* of the oil seal 181 is engaged with the recesses 104*a*, 104*b* by elastic deformation, so that the oil seal 181 is securely fixed and prevented from coming off the front housing 104. Thus, the recesses 104*a*, 104*b* serve as a stopper for the oil seal 181. Further, the oil seal 181 is press fitted into the front housing 104 by elastic deformation and thereby prevented from rotating in the circumferential direction. The rotation of the oil seal 181 in the circumferential direction is further effectively prevented by the plurality of recesses 104*a*, 104*b* of the front housing 104 in the circumferential direction. The driving mechanism 120 is assembled into the front housing 104 having the oil seal 181 mounted thereto. Specifically, the driving mechanism 120 is disposed within the front housing 104 such that the spindle 160 extends through the oil seal 181. By this arrangement, the oil seal 181 is arranged to seal a gap between the spindle 160 and the front housing 104. Further, the lip 181*b* formed in the inner circumferential part of the oil seal 181 is always held in contact with the spindle 160 so as to prevent lubricant from leaking out from the front of the front housing 104.

Figure 25:
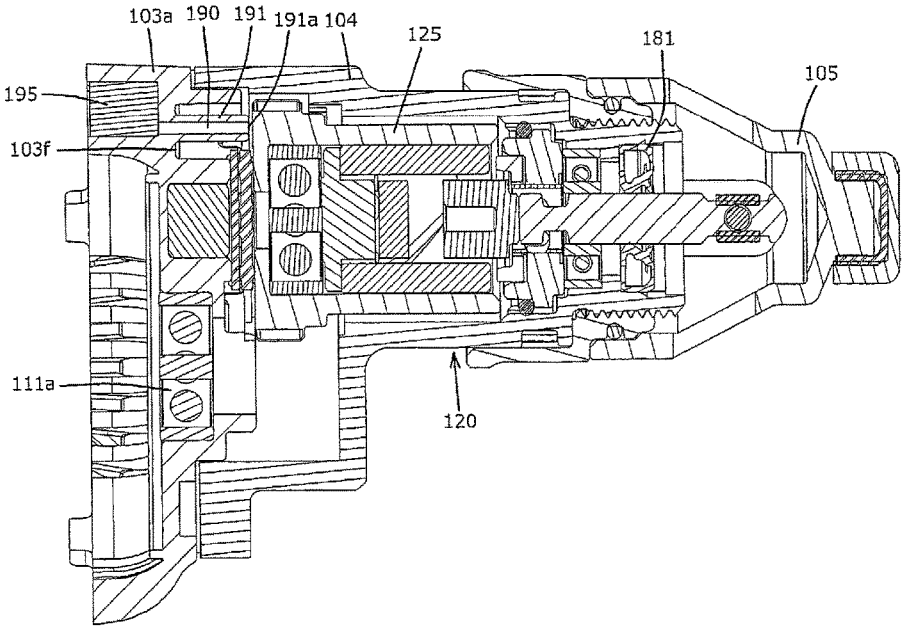
FIG. 25 is a sectional view taken along line XXV-XXV in FIG. 2.

On the rear of the front housing 104, as shown in FIG. 25, the bearing 111*a* serves to prevent lubricant from leaking out from between the output shaft 111 of the motor 110 and the partition wall 103*a*. Further, an air passage 190 is formed through the partition wall 103*a* to provide communication between the inside and the outside of the front housing 104. When the screwdriver 100 is driven, heat is generated within the front housing 104 by driving of the driving mechanism 120, so that air pressure within the front housing 104 increases. Particularly, in the screwdriver 100 of a small type, the front housing 104 has a small capacity, so that the fluctuation of air pressure within the front housing 104 is large. Therefore, the air passage 190 is formed in the partition wall 103*a* to release the pressure of the front housing 104 to the outside and thereby prevent increase of air pressure within the front housing 104. Specifically, the front housing 104 and the main housing 103 communicate with each other via the air passage 190. The air passage 190 is disposed behind the driving gear 125 and above the output shaft 111 (not shown in FIG. 25) of the motor 110. Further, as shown in FIGS. 1 and 3, the main housing 103 has an external communication part 106 formed by communication holes for providing communication between the inside of the main housing 103 and the outside of the screwdriver 100.

As shown in FIG. 25, in order to allow communication between the inside and the outside of the front housing 104 and prevent leakage of lubricant, the air passage 190 is provided and formed by a hollow part of a cylindrical (chimney-shaped) passage formation part 191 which extends forward from the vertically extending partition wall 103*a*. The air passage 190 is provided. Specifically, the passage formation part 191 has a passage opening 191*a* formed on the front end at a prescribed distance to the front from a front surface 103*f* of the partition wall 103*a* (on the front housing 104 side). With this structure, lubricant is prevented from flowing to the passage opening 191*a* along the partition wall 103*a*. The passage opening 191*a* is arranged close to the driving gear 125 and on the side of the rotation axis of the driving gear 125 with respect to the outer periphery of the driving gear 125 in the radial direction of the driving gear 125. When centrifugal force is generated by rotation of the driving gear 125, lubricant sticking to the driving gear 125 is moved outward in the radial direction of the driving gear 125. Therefore, lubricant can be prevented from entering the air passage 190 through the passage opening 191*a*. Such a structure having the air passage 190 can prevent leakage of lubricant from the front housing 104 and increase of air pressure within the front housing 104.

Further, an oil filter 195 is disposed in the partition wall 103*a* in preparation for leakage of lubricant through the air passage 190 having the above-described structure. The oil filter 195 is formed of a liquid absorbing material such as felt and sponge. The oil filter 195 is disposed in the rear of the partition wall 103*a* and at the rear of the air passage 190. Specifically, the oil filter 195 is held by the partition wall 103*a*. Therefore, air within the front housing 104 is led into the main housing 103 through the air passage 190 and the oil filter 195.

Second Embodiment

Figure 26:
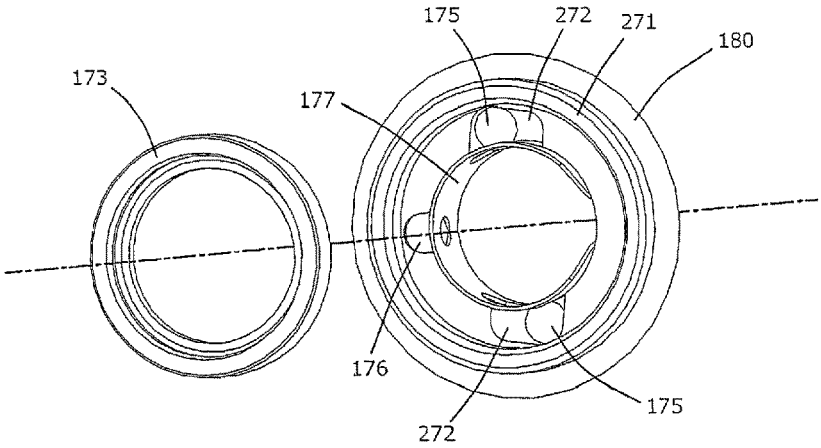
FIG. 26 is an exploded view of a stopper according to a second embodiment of the invention.

A second embodiment of the present invention is now described with reference to FIGS. 26 and 27. The second embodiment is different from the first embodiment in the shape of the retaining groove formed in the ball retaining ring of the stopper 170. Therefore, components other than the retaining groove are given like numerals as in the first embodiment, and they are not described.

Figure 27:
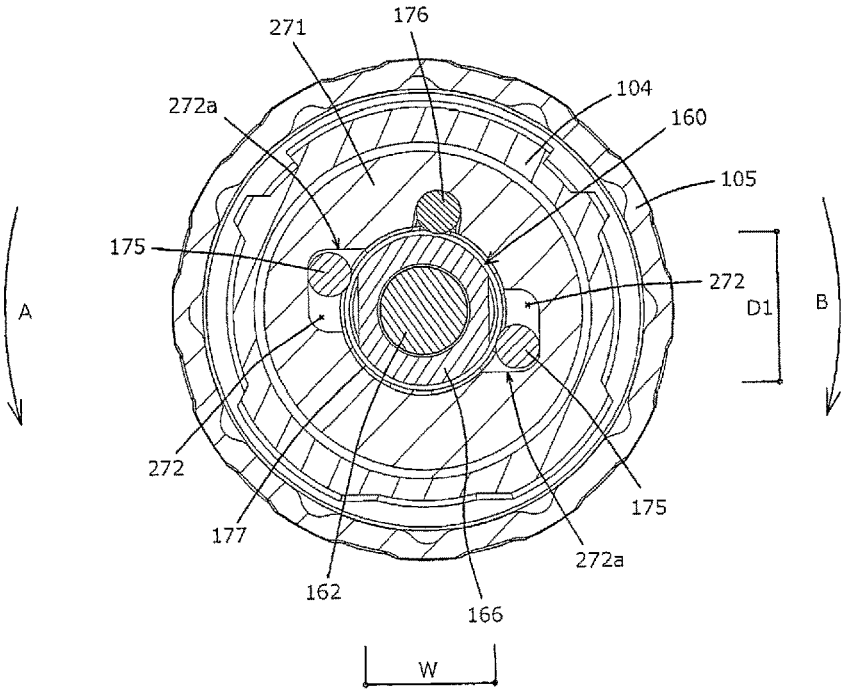
FIG. 27 is a sectional view showing the stopper during screw removing operation.

In the first embodiment, as shown in FIG. 15, the pocket-like region 172*a* is formed in the retaining groove 172, but in the second embodiment, as shown in FIG. 27, a radial movement allowable region 272*a* is formed in a retaining groove 272 in place of the pocket-like region 172*a*. The ball 175 gets in contact with a wall of the retaining groove 272 when the ball 175 moves in the direction B. The wall extends along a prescribed tangent of the inner periphery of a ball retaining ring 271, so that the radial movement allowable region 272*a* is formed in the retaining groove 272. Therefore, when the ball 175 is located in a position shown in FIG. 27 (the radial movement allowable region 272*a*), the ball 175 is allowed to move toward the center of the ball retaining ring 271 in the radial direction (the rotation axis of the spindle 160).

In the screw removing operation, the ball 175 is moved in the direction B within the retaining groove 272 in contact with the push ring 173 by rotation of the push ring 173 in the direction B and disposed in the radial movement allowable region 272*a*. The ball 175 disposed in the radial movement allowable region 272*a* is further moved toward the center of the ball retaining ring 271 in the radial direction (radially inward) by rotation of the push ring 173 in the direction B. Then, the ball 175 collides with the large-diameter part 166 of the spindle 160 rotating in the screw removing direction (the direction B), so that the ball 175 is moved radially outward within the radial movement allowable region 272*a*. Thereafter, the ball 175 is moved again toward the center of the ball retaining ring 271 in the radial direction (radially inward) by rotation of the push ring 173 in the direction B. Specifically, during the screw removing operation, the ball 175 periodically moves radially outward and inward within the radial movement allowable region 272*a*.

As a result, the ball 175 periodically collides with the large-diameter part 166 of the spindle 160 and generates collision noise. The ball 175 forms a rotation direction informing device which informs a user of rotation of the spindle 160 in the screw removing direction by the collision noise. Specifically, when the spindle 160 is located in the front position, the stopper 170 prevents the spindle 160 from rotating in the screw tightening direction and allows the spindle 160 to rotate in the screw removing direction, and also serves to inform the user of rotation of the spindle 160 in the screw removing direction. Therefore, prior to the screw removing operation, the user can easily confirm the rotation direction (screw removing direction) of the spindle 160. Therefore, in the second embodiment, it is not necessary to provide the LED 107*c*.

According to the above-described first and second embodiments, in screw tightening operation, when the spindle 160 is moved to the rear position by pressing, the inclined part 147*a* of the lock sleeve 145 and the inclined part 133*a* of the retainer 130 engage with each other and thereby move the rollers 140 with respect to the lock sleeve 145 in the circumferential direction of the retainer 130. Specifically, the rollers 140 are moved from the rotation transmission disabled position to the rotation transmission position in the circumferential direction of the retainer 130. Therefore, the movement of the spindle 160 in the axial direction of the spindle 160 is converted into the movement of the rollers 140 in the circumferential direction of the retainer 130 (the spindle 160). In this manner, the position of the rollers 140 can be rationally switched according to the screw tightening operation.

Further, according to the first and second embodiments, by using the rollers 140, rotation of the output shaft 111 of the motor 110 can be reliably transmitted to the spindle 160 by the wedge effect of the rollers 140 held between the driving gear 125 and the lock sleeve 145.

Further, according to the first and second embodiments, in the screw tightening operation, the rollers 140 are released from (the holding between) the driving gear 125 and the lock sleeve 145 as the screw (the spindle 160) moves. Particularly, by the resultant of the biasing force of the coil spring 155 in the axial direction of the spindle 160 and the reaction force that the lock sleeve 145 receives from the retainer 130 in the axial direction of the spindle 160 when the lock sleeve 145 rotates the retainer 130, the rollers 140 are released from the holding between the driving gear 125 and the lock sleeve 145. In order to release the rollers 140 solely by the biasing force of the coil spring 155, a larger biasing force of the coil spring 155 is required. By also utilizing the reaction force that the lock sleeve 145 receives from the retainer 130, however, the rollers 140 can be reliably released and transmission of rotation by the driving mechanism 120 is interrupted. Further, by utilizing the reaction force from the retainer 130 as well, the coil spring 155 having a smaller spring constant can be used.

Further, according to the first and second embodiments, in the idling state, the stopper 170 prevents rotation of the spindle 160 in the screw tightening direction. As a result, the spindle 160 can be reliably prevented from being caused to unintentionally rotate, for example, by lubricant solidified within the front housing 104. Therefore, in screw tightening operation, the spindle 160 is rotationally driven only when the spindle 160 is pressed. Further, in screw removing operation, since the stopper 170 allows the spindle 160 to rotate in the screw removing direction, the spindle 160 is rotationally driven without need of pressing the spindle 160. Thus, the spindle 160 is rationally driven according to the operation mode.

Further, according to the first and second embodiments, by providing the oil seal 181 in the front part of the front housing 104, lubricant is prevented from leaking out from the front of the front housing 104. The oil seal 181 is prevented from coming off in the axial direction of the spindle 160 by elastic deformation of the base 181*a* of the oil seal 181 and also prevented from rotating in the circumferential direction when the spindle 160 rotates. In other words, the oil seal 181 is securely fixed in the axial direction and the circumferential direction of the spindle 160. Further, by providing the recesses 104*a*, 104*b* in the front housing 104, movement of the oil seal 181 in the axial direction and the circumferential direction of the spindle 160 is more effectively prevented. This fixation of the oil seal 181 is particularly useful with respect to the spindle 160 which rotates around its axis and moves in the axial direction.

Further, according to the first and second embodiments, increase of air pressure within the front housing 104 is prevented by the air passage 190. Further, lubricant leaking through the air passage 190 is reliably caught by the oil filter 195 and prevented from leaking to the outside of the screwdriver 100. In a structure in which the output shaft 111 of the motor 110 is arranged in parallel to the axial direction of the spindle 160 (the tool bit 119), the motor 110 is disposed behind the driving mechanism 120 in consideration of the position of the center of gravity of the screwdriver 100. Therefore, a free space is created behind the driving mechanism 120 above the motor 110. The air passage 190 and the oil filter 195 are arranged in such a space, so that components of the screwdriver 100 are rationally arranged.

In the above-described embodiments, the LED 107*c* informs the user by illuminating that a screw removing operation is performed. The informing structure is not limited to this. For example, the LED 107*c* may flash, or emit light in different colors to inform that a screw removing operation is performed. Further, as the rotation direction informing device, an actuator which generates vibration and noise may be provided. Further, the rotation direction informing device may inform the user not only of rotation of the spindle 160, 360 (the tool bit 119) in the screw removing direction in a screw removing operation, but of rotation of the spindle 160, 360 (the tool bit 119) in the screw tightening direction in a screw tightening operation.

Further, in the above-described embodiments, in order to release the holding of the rollers 140 between the driving gear 125 and the lock sleeve 145, the lock sleeve 145 is moved forward by mechanical contact between the inclined parts 133*a*, 147*a* in cooperation with the biasing force of the coil spring 155. The lock sleeve 145 may however be moved forward in other methods. Specifically, the lock sleeve 145 may be moved forward solely by contact between the inclined parts 133*a*, 147*a* of which inclination angles are appropriately set. Further, for example, in addition to the inclined parts 133*a*, 147*a*, a releasing means may be provided to detect contact of the locator 105 with the workpiece during screw tightening operation and move the lock sleeve 145 forward so as to release the holding of the rollers 140 between the driving gear 125 and the lock sleeve 145. Further, only either one of the inclined parts 133*a*, 147*a* may be provided.

Further, in the above-described embodiments, the driving member or the driving gear 125 has a cylindrical inside shape and the driven member or the lock sleeve 145 has a prismatic outside shape, but they may be shaped otherwise.

The driving member may have a prismatic inside shape and the driven member may have a cylindrical outside shape Further, in the above-described embodiments, the releasing mechanism for releasing the rollers 140 is provided to move the lock sleeve 145 and the retainer 130 in the axial direction and the circumferential direction with respect to each other by utilizing the inclined parts 133*a*, 147*a*, but the releasing mechanism is not limited to this. For example, in addition to the driving mechanism 120, a driving device may be provided to move the retainer 130 from the holding position to the holding disabled position by movement of the retainer 130 with respect to the driving gear 125. In this case, the driving device is driven by the motor 110 and serves as a releasing mechanism. Further, the timing when the driving device releases the rollers 140 is appropriately set by controlling the timing when the driving device is driven by the motor 110.

Further, in the above-described embodiments, the inclined parts 133*a*, 147*a* are provided, but, for example, either one of the inclined parts may be provided. In this case, in the other member having no inclined part, a contact part is formed to slide in contact with the inclined part.

In view of the nature of the present invention, a screw tightening tool according to this invention may have the following features. Each feature may be used alone or in combination with others, or in combination with the claimed invention.

(Aspect 1)

The intervening member is held between the tool accessory driving shaft and the driving member and thereby exhibits a wedge effect so that the driving member, the intervening member and the tool accessory driving shaft rotate together by the wedge effect.

(Aspect 2)

The driving member has a cylindrical inside shape and the tool accessory driving shaft has a generally prismatic outside shape, as viewed in a cross section perpendicular to the rotation axis of the tool accessory.

(Aspect 3)

The first holding member has a generally prismatic outside shape, as viewed in a section perpendicular to the rotation axis of the tool accessory.

(Aspect 4)

The releasing mechanism releases the intervening member by utilizing relative movement of the first element and the second element in the axial direction of the tool accessory driving shaft and in the circumferential direction around the axial direction, which movement is caused by sliding of the inclined surface formed on one of the first element and the second element and the contact part formed on the other element with respect to each other.

(Aspect 5)

The releasing mechanism releases the intervening member by utilizing relative movement of the first element and the second element in the axial direction of the tool accessory driving shaft and in the circumferential direction around the axial direction and the biasing force of the biasing member.

(Aspect 6)

The second holding member has a second holding part which can hold the intervening member between the second holding member and the driving member.

Correspondences Between the Features of the Embodiments and the Features of the Invention Correspondences between the features of the embodiments and the features of the invention are as follows. The above-described embodiments are representative examples for embodying the present invention, and the present invention is not limited to the structures that have been described as the representative embodiments.

The screwdriver 100 is an example embodiment that corresponds to the "screw tightening tool" according to the present invention.

The motor 110 is an example embodiment that corresponds to the "motor" according to the present invention.

The driving mechanism 120 is an example embodiment that corresponds to the "driving mechanism" according to the present invention.

The driving gear 125 is an example embodiment that corresponds to the "driving member" according to the present invention.

The spindle 160 is an example embodiment that corresponds to the "tool accessory driving shaft" according to the present invention.

The spindle 160 is an example embodiment that corresponds to the "tool accessory holding shaft" according to the present invention.

The lock sleeve 145 is an example embodiment that corresponds to the "tool accessory driving shaft" according to the present invention.

The lock sleeve 145 is an example embodiment that corresponds to the "first element" according to the present invention.

The lock sleeve 145 is an example embodiment that corresponds to the "first holding member" according to the present invention.

The inclined part 147*a* is an example embodiment that corresponds to the "second inclined surface" according to the present invention.

The inclined part 147*a* is an example embodiment that corresponds to the "contact part" according to the present invention.

The roller engagement part 146 is an example embodiment that corresponds to the "holding part" according to the present invention.

The retainer 130 is an example embodiment that corresponds to the "second element" according to the present invention.

The inclined part 133*a* is an example embodiment that corresponds to the "inclined surface" according to the present invention.

The second side wall 133 is an example embodiment that corresponds to the "retaining part" according to the present invention.

The roller 140 is an example embodiment that corresponds to the "intervening member" according to the present invention.

The spring receiver 150 is an example embodiment that corresponds to the "second holding member" according to the present invention.

The ball 153 is an example embodiment that corresponds to the "biased member" according to the present invention.

The coil spring 155 is an example embodiment that corresponds to the "biasing member" according to the present invention.

DESCRIPTION OF NUMERALS

100 screwdriver
101 body
103 main housing
103*a* partition wall
103*f* front surface

104 front housing
104*a* recess
104*b* recess
104*c* large-diameter part
105 locator
106 external communication part
107 handle
107*a* trigger
107*b* changeover switch
107*c* LED
109 power cable
110 motor
111 output shaft
112 gear teeth
119 tool bit
120 driving mechanism
121 needle bearing
122 front bearing
123 rear bearing
125 driving gear
126 bottom wall
127 side wall
128 gear teeth
130 retainer
131 base
131*a* engagement hole
131*b* ball retaining part
132 first side wall
133 second side wall
134 roller retaining part
139 engagement pin
140 roller
145 lock sleeve
146 roller engagement part
147 retainer engagement part
147*a* inclined part
150 spring receiver
150*a* engagement hole
151 roller engagement part
152 ball contact part
153 ball
155 coil spring
160 spindle
161 front shaft part
162 rear shaft part
162*a* groove
163 hollow part
164 communication hole
165 rear end bearing
166 large-diameter part
166*b* width across flat part
167 small-diameter part
170 stopper
171 ball retaining ring
172 retaining groove
172*a* pocket-like region
173 push ring
175 ball
176 ball
177 leaf spring
177*a* through hole
177*b* engagement hole
180 O-ring
181 oil seal
181*a* base
181*b* lip
190 air passage
191 passage formation part
191*a* passage opening
195 oil filter
271 ball retaining ring
272 retaining groove
272*a* radial movement allowable region

The invention claimed is:

1. A power tool, which performs a prescribed operation by rotationally driving a tool accessory detachably coupled to a front end region, comprising:

a motor, and a driving mechanism that is driven by the motor and rotationally drives the tool accessory, the driving mechanism including:

a tool accessory driving shaft to which the tool accessory is coupled, a driving member that is coaxially disposed with the tool accessory driving shaft and rotationally driven by the motor, and an intervening member that is disposed between the tool accessory driving shaft and the driving member and transmits rotation of the driving member to the tool accessory driving shaft when held between the tool accessory driving shaft and the driving member, while interrupting the transmission of rotation of the driving member to the tool accessory driving shaft when released from the holding, and a releasing mechanism that is driven by the motor and releases the holding.

2. The power tool as defined in claim 1, wherein:

the tool accessory driving shaft is configured to be movable between a first position close to the front end region and a second position away from the front end region in an axial direction of the tool accessory driving shaft, when the tool accessory driving shaft is located in the second position, the intervening member is held between the tool accessory driving shaft and the driving member in a prescribed holding position and transmits rotation of the driving member to the tool accessory driving shaft, and when the tool accessory driving shaft is located in the first position, the intervening member is disposed in a holding disabled position which is different from the holding position and in which the intervening member is not held between the tool accessory driving shaft and the driving member, so that the transmission of rotation of the driving member to the tool accessory driving shaft is interrupted.

3. The power tool as defined in claim 2, wherein the releasing mechanism moves the tool accessory driving shaft from the second position to the first position in the axial direction of the tool accessory driving shaft, and at the same time, moves the intervening member from the holding position to the holding disabled position in a circumferential direction around an axis of the tool accessory driving shaft.

4. The power tool as defined in claim 3, wherein:

the releasing mechanism includes a first element and a second element to contact with the first element, one of the first element and the second element has an inclined surface inclined at a prescribed angle with respect to the axial direction of the tool accessory driving shaft, and the other element has a contact part that can get into contact with the inclined surface, in a state in which the tool accessory driving shaft is located in the second position and the intervening member is held between the tool accessory driving shaft and the driving member in the holding position, when the first element and the second element move with respect to each other in the circumferential direction of the tool accessory driving shaft by rotation of the motor, the contact part slides in contact with the inclined surface and the first and second elements move with respect to each other in the axial direction of the tool accessory driving shaft, whereby the releasing mechanism moves the tool accessory driving shaft from the second position to the first position, and at the same time, moves the intervening member from the holding position to the holding disabled position.

5. The power tool as defined in claim 4, wherein the second element comprises a retainer that retains the intervening member in the holding position and the holding disabled position and rotates together with the tool accessory driving shaft with the intervening member held in the holding position.

6. The power tool as defined in claim 5, wherein:

the tool accessory driving shaft includes a tool accessory holding shaft that holds the tool accessory, and a first holding member that can hold the intervening member between the first holding member and the driving member and rotates together with the tool accessory holding shaft while holding the intervening member therebetween, and the first element comprises the first holding member.

7. The power tool as defined in claim 6, wherein:

the tool accessory driving shaft further includes a second holding member, normal rotation of the motor is transmitted to the tool accessory holding shaft when the intervening member is held between the first holding member and the driving member, and reverse rotation of the motor is transmitted to the tool accessory holding shaft when the intervening member is held between the second holding member and the driving member.

8. The power tool as defined in claim 7, wherein the retainer comprises a ring-like member that is coaxially disposed with the tool accessory driving shaft, and the second holding member is disposed inward of the outer periphery of the retainer in a radial direction of the retainer.

9. The power tool as defined in claim 6, wherein:

the retainer comprises a ring-like member that is coaxially disposed with the tool accessory driving shaft, and has a retaining part that retains the intervening member at a prescribed distance away from a rotation axis of the tool accessory driving shaft in a radial direction of the retainer, and the first holding member has the inclined surface which is formed in a region at the prescribed distance away from the rotation axis of the tool accessory driving shaft in the radial direction of the retainer and configured to correspond to the retaining part, and a holding part which is formed on the rotation axis side with respect to the inclined surface and can hold the intervening member between the holding part and the driving member.

10. The power tool as defined in claim 9, wherein the intervening member comprises a plurality of rollers extending in the axial direction of the tool accessory driving shaft, and the retaining part of the retainer is provided between the rollers and has the contact part configured as a second inclined surface which is inclined in the axial direction of the tool accessory driving shaft at the same angle as the inclined surface.

11. The power tool as defined in claim 3, wherein:

the releasing mechanism includes a first element and a second element that can get into contact with the first element, one of the first element and the second element has an inclined surface inclined at a prescribed angle with respect to the axial direction of the tool accessory driving shaft, and the other element has a contact part that can get into contact with the inclined surface, in a state in which the tool accessory driving shaft is located in the first position and the intervening member is not held between the tool accessory driving shaft and the driving member in the holding disabled position, when the first element and the second element move with respect to each other in the axial direction of the tool accessory driving shaft by movement of the tool accessory driving shaft from the first position to the second position, the contact part slides in contact with the inclined surface and the first and second elements move with respect to each other in the circumferential direction of the tool accessory driving shaft, whereby the releasing mechanism moves the intervening member from the holding disabled position to the holding position.

12. The power tool as defined in claim 1, wherein at least one of components for forming the driving mechanism forms the releasing mechanism.

13. The power tool as defined in claim 1, further comprising a biasing member that always biases the tool accessory driving shaft toward the front end region.

14. The power tool as defined in claim 13, wherein:

the driving member is cylindrically shaped, the power tool includes a biased member that is biased in the radial direction of the driving member by the biasing member so as to get in contact with an inner circumferential surface of the driving member, and when the motor is rotated reversely, the biased member moves the intervening member in the circumferential direction of the driving member by utilizing rotation of the driving member such that the intervening member is held between the driving member and the second holding member.

* * * * *